US011057718B2

(12) United States Patent
King et al.

(10) Patent No.: US 11,057,718 B2
(45) Date of Patent: Jul. 6, 2021

(54) LOAD CHANGE DIAGNOSTICS FOR ACOUSTIC DEVICES AND METHODS

(71) Applicant: Knowles Electronics, LLC, Itasca, IL (US)

(72) Inventors: Charles King, Oak Park, IL (US); Andrew Unruh, San Jose, CA (US); Daniel Warren, Geneva, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/475,748

(22) PCT Filed: Jan. 5, 2018

(86) PCT No.: PCT/US2018/012472
§ 371 (c)(1),
(2) Date: Jul. 3, 2019

(87) PCT Pub. No.: WO2018/129242
PCT Pub. Date: Jul. 12, 2018

(65) Prior Publication Data

US 2019/0327563 A1 Oct. 24, 2019

Related U.S. Application Data

(60) Provisional application No. 62/442,963, filed on Jan. 5, 2017.

(51) Int. Cl.
*H04R 25/00* (2006.01)

(52) U.S. Cl.
CPC ..... *H04R 25/305* (2013.01)

(58) Field of Classification Search
CPC ..... H04R 25/305
See application file for complete search history.

(56) References Cited

U.S. PATENT DOCUMENTS 8,379,899 B2 * 2/2013 Van Halteren ..... H04R 11/04 381/352
8,401,215 B2 3/2013 Warren et al.
(Continued)

FOREIGN PATENT DOCUMENTS

CN 204906666 U 12/2015
EP 1467595 A2 * 10/2004 ..... H04R 25/305
(Continued)

OTHER PUBLICATIONS

China National Intellectual Property Administration; Chinese Office Action; Chinese Appl. No. 201880012445.8; dated Aug. 28, 2020.
(Continued)

*Primary Examiner* — Regina N Holder
(74) *Attorney, Agent, or Firm* — Faegre Drinker Biddle & Reath LLP

(57) ABSTRACT

An acoustic apparatus and method produces an acoustic signal in response to an electrical input signal applied to an acoustic receiver. The acoustic signal is converted to an electrical output signal that is proportional to a sound pressure of the acoustic signal, using an electro-acoustic transducer. In some embodiments the apparatus and method determine whether there is a change in the acoustic signal indicative of a change in an acoustic load coupled to the receiver by comparing the electrical output signal to reference information. The change in acoustic load, in one example, is attributable to ear wax accumulation in an output of the acoustic receiver or acoustic passage in the ear canal of a user or is attributable to seal leakage.

19 Claims, 27 Drawing Sheets

(56) References Cited

U.S. PATENT DOCUMENTS

| | | | | |
|---|---|---|---|---|
| 2010/0254556 | A1* | 10/2010 | Warren | H04R 1/2842 381/328 |
| 2014/0153737 | A1* | 6/2014 | Geschiere | H04R 1/2857 381/74 |
| 2014/0270206 | A1 | 9/2014 | Port | |

FOREIGN PATENT DOCUMENTS

| | | | | |
|---|---|---|---|---|
| EP | 1467595 | A2 | 10/2004 | |
| WO | 2007/144010 | A1 | 12/2007 | |
| WO | 2012/107100 | A1 | 8/2012 | |
| WO | WO-2012107100 | A1 * | 8/2012 | H04R 25/30 |
| WO | 2015/011525 | A1 | 1/2015 | |
| WO | 2020/086444 | A1 | 4/2020 | |

OTHER PUBLICATIONS

European Patent Office; International Search Report and Written Opinion; International Application No. PCT/US2018/012472; dated May 8, 2018.

* cited by examiner

AMPLIFIER AND RECEIVER

108

FRONT CAVITY MIC

REAR CAVITY MIC

REAR CAVITY MIC

REAR CAVITY BEHIND TUBE

REAR CAVITY BEHIND TUBE

TUBE MONITORING

LOAD CHANGE DIAGNOSTICS FOR ACOUSTIC DEVICES AND METHODS

RELATED APPLICATIONS

This application relates to U.S. Provisional Patent Application Ser. No. 62/409,341 filed on Oct. 17, 2016, and entitled "Armature-Based Acoustic Receiver Having Improved Output and Method," the entire content of which is hereby incorporated by reference.

TECHNICAL FIELD

This disclosure relates generally to acoustic devices and more specifically to acoustic load change diagnostics in acoustic devices, electrical circuits therefor and corresponding methods.

BACKGROUND

Acoustic devices including a balanced armature receiver that converts an electrical input signal to an acoustic output signal characterized by a varying sound pressure level (SPL) are known generally. Such devices may be embodied as hearing aids, headsets, or ear buds worn by a user. The receiver generally comprises a motor having a coil to which an electrical excitation signal is applied. The coil is disposed about a portion of an armature (also known as a reed), a movable portion of which is disposed in equipoise between magnets, which are typically retained by a yoke. Application of the excitation or input signal to the receiver coil modulates the magnetic field, causing deflection of the reed between the magnets. The deflecting reed is linked to a movable portion of a diaphragm (known as a paddle) disposed within a partially enclosed receiver housing, wherein movement of the paddle forces air through a sound outlet or port of the housing. The performance of such acoustic devices may be adversely affected by sub-optimal coupling, or obstruction of the acoustic output signal, among other conditions tending to change the acoustic load coupled to the device.

The objects, features, and advantages of the present disclosure will be more apparent to those of ordinary skill in the art upon consideration of the following Detailed Description with reference to the accompanying drawings.

Figure 1:
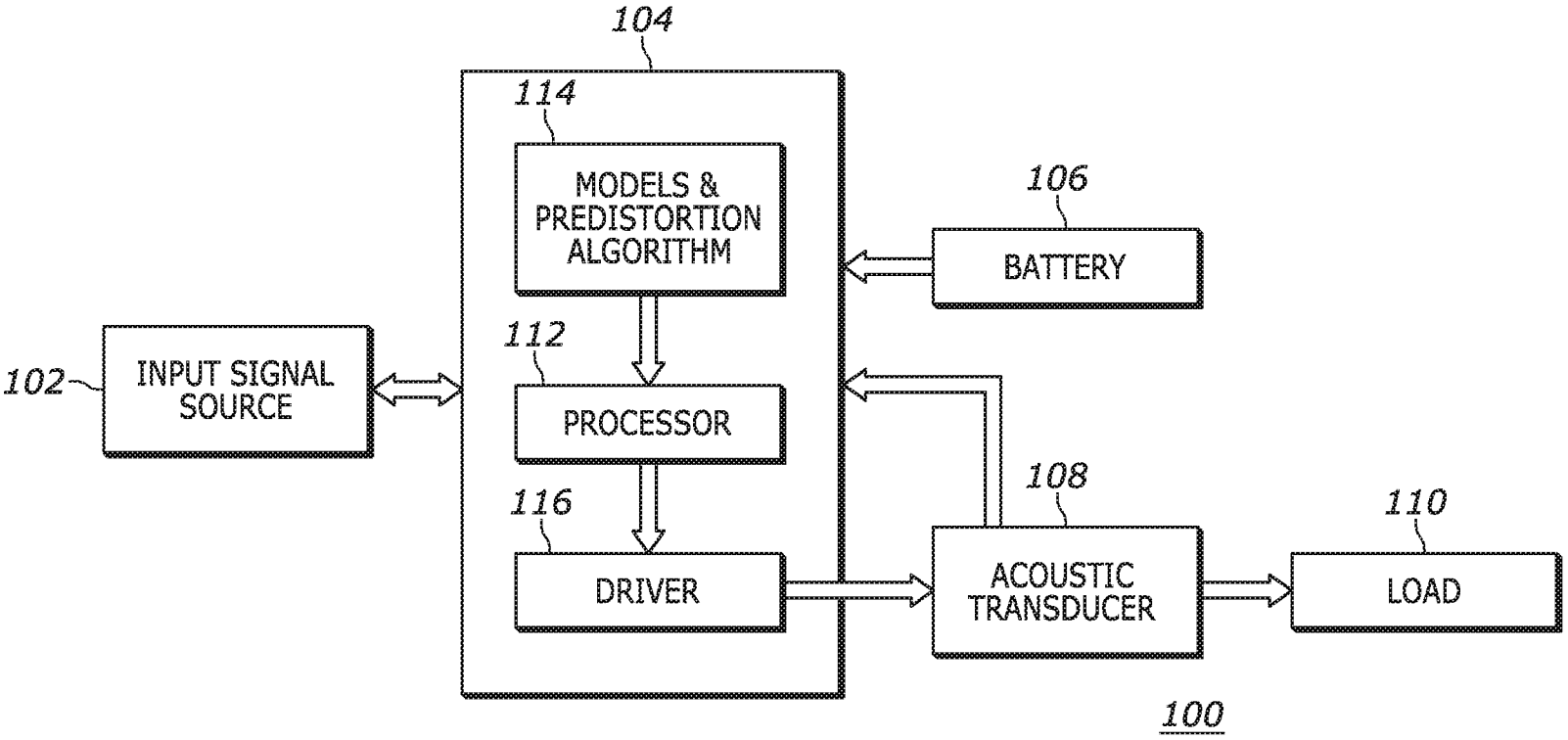
FIG. 1 is a block diagram of a system for generating a pre-distorted excitation signal for input to an armature-based receiver.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

Generally, acoustic devices and methods are disclosed for producing an acoustic output signal in response to an electrical input signal. The transduction of the electrical input signal may be performed by an acoustic receiver (also referred to herein as a "receiver"). In one embodiment, the receiver is embodied as an armature-based receiver comprising an armature linked to a diaphragm that separates a receiver housing into a front volume and a back volume, wherein the front volume is coupled to an output port of the housing by an acoustic passage. In some embodiments the acoustic passage includes a spout on which the output port is disposed. In other embodiments, the acoustic passage includes a chamber (also referred to as a doghouse) between the front volume and the output port of the receiver. In other embodiments, the receiver is embodied as a dynamic speaker comprising a diaphragm that separates a receiver housing into a front volume and a back volume. The acoustic device may be embodied as a receiver or as a receiver integrated with some other device like a hearing aid, a headset, an earbud or earpiece or as some other device that produces an acoustic output signal in response to an electrical input signal and is intended for use in close proximity to a user's ear.

According to one aspect of the disclosure, the acoustic output signal of the receiver is converted to an electrical output signal that is related to a sound pressure of the acoustic signal using one or more electro-acoustic transducers (e.g., microphones) located in, on, or near the acoustic device. In one embodiment, the receiver device includes at least one microphone positioned to detect sound pressure in at least one of the front volume, the back volume, or the output passage of the receiver. There may be differing advantages to locating microphones to sense sound pressure in different areas of the receiver as described herein. In some implementations, sound pressures detected in multiple location of the receiver housing are also used to determine the load change.

A change in the acoustic output signal is used to determine a change in an acoustic load coupled to the acoustic device. In one embodiment, a notification of the change in load is provided or made available to the user or to a service technician. In another embodiment, the performance of the acoustic device may be automatically adjusted to compensate for the change in the acoustic load. In other embodiments, both notification and compensation are provided. These and other aspects of the disclosure are discussed further herein.

The acoustic load may characterized generally as the size, shape and leakage associated with a volume of air into which sound pressure of the receiver emanates. For example, a receiver disposed in an earpiece includes an output port that is typically coupled to a sound port of the earpiece by an acoustic tube. In use, the earpiece may be coupled to a user ear with more or less leakage. Thus, in this example, the acoustic conduit of the earpiece, the user's ear canal and leakage of the coupling therebetween, among other factors, contribute to the acoustic load. Generally, environmental factors like temperature, humidity and pressure also affect the acoustic load.

The change in acoustic load, in one example, is attributable to an obstruction of the acoustic output signal of the acoustic device. Such an obstruction may be caused by an accumulation of foreign matter in some portion of the acoustic device. Foreign matter includes moisture, earwax, also known as cerumen, or other debris, and combinations thereof tending to infiltrate the acoustic device. For example, the obstruction may occur in a sound port of an earbud or earpiece of the acoustic device, or in a tube interconnecting the sound port to an output port of the receiver. In some acoustic devices, the foreign matter may migrate through structure toward and accumulate in portions of receiver. The diagnosis of obstructions may be performed whether or not the acoustic device is in use. Thus for obstruction diagnosis at least one of the sound port of the acoustic device, or any acoustic tubing interconnecting the sound port and the output port of the receiver, or any obstruction of the output port of the receiver may affect the acoustic load.

In another example, the change in acoustic load is attributable to a change in an acoustic coupling between the hearing device and the user's ear. Such coupling changes may result from seal leakage or possibly from an overly tight seal associated with the coupling. More generally, the acoustic load may change for reasons other than obstruction or coupling issues discussed in the examples above. Whatever the cause, the load change is diagnosed by sensing a change in the acoustic output as discussed further herein. The diagnosis of coupling issues requires that the acoustic device be coupled to the load (e.g., positioned on a user). For purposes of coupling detection, at least the coupling characteristics (e.g., seal or leakage) between the acoustic device and the user or other apparatus to which the acoustic device is acoustically coupled affect the acoustic load.

Generally, the change in the acoustic load may be determined by comparing the acoustic output signal to reference information. For this purpose, an electrical circuit is operative to determine whether there is a change in an acoustic signal of the receiver by comparing an electrical output signal representative of the acoustic output signal to the reference information, wherein the electrical output signal is generated by a microphone positioned to sense an acoustic output of the acoustic device. The reference information is stored in memory of the electrical circuit. The electrical circuit may also determine the extent or degree of the change in the acoustic load. In some embodiments, the electrical circuit also controls the performance of the receiver by applying equalization to the electrical input signal to compensate for the changes in the acoustic load. The electrical circuit may be implemented by a processor executing an acoustic load change determination algorithm or by equivalent hardware circuits or a combination thereof. In embodiments where pre-distortion is also applied, the signal representative of the desired acoustic output is equalized prior to the pre-distortion processing.

In one embodiment, the comparison is performed by an electrical circuit integrated with (e.g., disposed within or on) the receiver or by an electrical circuit integrated with another portion of the acoustic device with which the receiver is integrated or used in combination. The other portion of the acoustic device may be, for example, a behind-the-ear unit or an in-the-canal earpiece of a hearing device, an earbud, a headset housing portion, or some other structure with which the receiver is integrated. Alternatively, the comparison may be performed by an electrical circuit located remotely from the acoustic device, for example, in a cloud server (such as a web server), a mobile device, a hearing device test station, or at a servicing facility among other remote devices or locations. Remote processing requires that information from the acoustic device, like the acoustic output signal, or the electrical output signal representative thereof, be provided to the remote device or location for processing as discussed herein.

In one embodiment, the reference information is a maximum sound pressure capable of being produced in a front volume of the receiver at one or more reference frequencies in the absence of obstruction of an output of the receiver. In one implementation, the one or more frequencies are below a resonance frequency of the receiver. The resonance frequency may be a primary mechanical resonance frequency or an acoustic resonance frequency. According to this embodiment, obstruction may be detected when the acoustic output measured in the front volume of the receiver at the one or more reference frequencies is greater than the defined reference information. This approach is largely suitable for detecting obstruction and is incapable providing a measure of the degree of obstruction. The maximum sound pressure capable of being produced in a front volume of the receiver as a function of frequency can be calculated or measured at the time of manufacture or created during a post manufacturing calibration procedure.

In other embodiments, the reference information is an expected transfer function comprising a ratio of a reference acoustic output signal of the receiver to a reference electrical input signal of the receiver. The expected transfer function may be a function of one or more frequencies. In one approach, expected transfer function is based on acoustic output is measured over a specified frequency range in response to an electrical input signal having a fixed amplitude. The expected transfer function could be calculated or measured at the time of manufacture or created during a post manufacturing calibration procedure.

Generally, the expected transfer function is determined for a specified load condition. For example, the expected transfer function may be determined for an uncoupled acoustic device without obstruction. A different expected transfer function could be determined for an optimally coupled acoustic device without obstruction, for example, by a service technician or a user invoking an initialization algorithm executed by the electrical circuit upon properly coupling the acoustic device (e.g., fitting the device on the user). A coupling sensor on the acoustic device could indicate whether or not the device is coupled and invoke the appropriate expected transfer function depending on whether the diagnostic is performed when the device is coupled or not.

The expected transfer function (also referred to as sensitivity) of the receiver is substantially linear over a known range of operation of the receiver (e.g., in response to relatively low to intermediate amplitude electrical input signals). Applying pre-distortion to the input signal as described in U.S. Application No. 62/409,341 filed on Oct. 17, 2016, and entitled "Armature-Based Acoustic Receiver Having Improved Output and Method," will increase the range of linear operation of the receiver. However, if the expected transfer is modeled to accommodate non-linear operation of the receiver, changes in the acoustic load may be determined for non-linear operation of the receiver. In any case, changes in the load can be determined by comparing the expected transfer function with a measured transfer function, provided the receiver is operated in it linear range (i.e., the electrical input signal is not sufficiently large to cause non-linear operate of the receiver).

In these embodiments, the electrical circuit is operative to determine whether there is a change in the acoustic signal by comparing data representing a measured transfer function of the receiver to data representing the appropriate expected transfer function of the receiver. The measured transfer function is a ratio of an acoustic output signal of the receiver to an electrical input signal of the receiver. The measured transfer function is a measure of the transfer function at some time after manufacture. The measured transfer function could be the same as or different than the expected transfer function depending on the acoustic load conditions. This approach is suitable for detecting any load change, and permits determining the extent of the change.

Generally, the comparison of the transfer function may be performed at one or more frequencies. In one implementation, the transfer function are compared a single frequency, for example, at a mechanical or acoustical resonance of the receiver. Differences in the amplitudes of the transfer functions at a particular frequency are indicative of a load change. In some embodiments, the electrical circuit is operative to compare the measured transfer function to the expected transfer function for a range of frequencies between approximately 1 octave below a resonance frequency of the receiver and approximately 1 octave above a resonance frequency of the receiver. In one implementation, the resonance frequency is a primary mechanical resonance frequency of the receiver. In another implementation, the resonance frequency is an acoustical resonance frequency of the receiver. Generally the acoustical resonance frequency may be above or below the primary mechanical resonance frequency of the receiver. Differences in the amplitudes of the transfer functions at multiple frequencies may represent a measure of slope which is also indicative of a load change. Differences in the amplitudes of the transfer functions at multiple frequencies may be used to locate maxima or minima or changes in maxima or minima, corner frequencies, any one or more of which may be indicative of a change in acoustic load.

In some embodiments the electrical circuit is operative to provide a diagnostic electrical input signal to the receiver to diagnose changes in the acoustic load. The acoustic output signal may be represented by an electrical output signal generated by a microphone positioned to detect sound pressure associated with the acoustic output of the receiver as discussed herein. The acoustic output signal may be represented by an electrical output signal generated by a microphone positioned to detect sound pressure associated with the acoustic output of the receiver as discussed herein. The diagnostic signal generated by the electrical circuit. The diagnostic signal could be a single tone with known parameters (e.g., magnitude, frequency and phase), or a stepped frequency signal with known parameters or a swept frequency signal with known parameters, among other signals with known parameters. Other diagnostic signals can also be used including, among others, chirps, pink noise, white noise, etc. Less well defined signal can be used if with coherence checks. This type of test can be done as device is used and would occur as the device is being used.

The diagnostic signal may be audible or inaudible. Inaudible signals are generally imperceptible to the user because the frequency is outside the audible range, or because the amplitude or level of a signal in the audible frequency range is below the threshold of hearing, or because signal in the audible frequency range is masked by other sound presented concurrently. Input signals having sub-audible frequencies may be best detected by an electro-acoustic transducer located in the front volume of the receiver. The use of an inaudible signal for load change diagnosis purposes will not interrupt the user's listening pleasure when the acoustic device is in use. In embodiments where a measured transfer function is compared to a reference transfer function, the measured transfer function is a ratio of the acoustic output signal and the diagnostic signal.

In other embodiments, the electrical circuit determines change in the acoustic load using a signal from an external source. An electrical input signal obtained from an external source may originate from a microphone in a hearing aid, from an audio playback device, or from some other device.

In some embodiments, the electrical circuit conditions the signal obtained from the external source before application of the signal to the receiver. For example, a signal obtained from the microphone in a hearing aid device may be subject to filtering, impedance matching, and amplification before application to the receiver. Other external signals may require other processing. Alternatively, the electrical circuit may merely function as a conduit to pass the signal from the external source directly to the receiver. In embodiments where a measured transfer function is compared to a reference transfer function, the electrical circuit must determine parameters of the signal from the external source in order to perform the comparison. Such a measurement is generally performed at a particular frequency or at a range of frequencies.

In some embodiments the electro-acoustic transducer is disposed on a substrate that forms part of the front volume, or back volume, or output passage of the receiver depending on where sound pressure detection is desired. In embodiments where the electro-acoustic transducer is located to sense sound pressure in the back volume or front volume of the receiver, the electro-acoustic transducer substrate forms part of the back volume or the front volume, respectively. In embodiments where the electro-acoustic transducer is located to sense sound pressure in the output passage of the receiver, the electro-acoustic transducer substrate forms part of the output passage. As suggested herein, some embodiments may include multiple microphones, and thus the microphone substrate or substrates may constitute more than one volume or passage of the receiver.

In some embodiments an armature based acoustic receiver includes a housing having a diaphragm that defines a front volume, a back volume, and an output port coupled to the front volume. The receiver includes at least one electro-acoustic transducer positioned to sense sound pressure in at least one of the front volume and the back volume.

In some embodiments an electrical circuit, implemented as one or more integrated circuits for use in combination with an armature based acoustic receiver, is operative to apply an electrical input signal at an output of the integrated circuit. The electrical circuit also operative to determine whether there is a change in an acoustic signal of the receiver by comparing data representing an acoustic output of the receiver to reference data for the receiver. In one embodiment, a measured transfer metric is compared to data representing an expected transfer function. The measured transfer metric is a ratio of an acoustic output signal of the receiver to the electrical input signal, and the expected transfer function is a ratio of a reference acoustic output signal of the receiver to a reference electrical input signal of the receiver for a reference load.

In some embodiments the integrated circuit is operative to determine whether there is a change in the acoustic signal by comparing data representing a measured transfer function of the receiver to data representing an expected transfer function of the receiver, wherein the measured transfer function is a ratio of an acoustic output signal of the receiver to an electrical input signal of the receiver, and the expected transfer function is a ratio of a reference acoustic output signal of the receiver to a reference electrical input signal of the receiver for a reference test load.

In some embodiments the integrated circuit is operative to compare the measured transfer function to the expected transfer function for a range of frequencies between approximately 1 octave below a resonance frequency of the receiver and approximately 1 octave above the resonance frequency of the receiver.

In some embodiments the integrated circuit is operative to provide a notification when there is a change in the acoustic signal indicative of a change in the acoustic load.

In some embodiments the electrical circuit determines that the change in the acoustic signal is indicative of obstruction of the output, wherein the expected transfer function is a ratio of the reference acoustic output signal to a reference electrical input signal for a reference test load representing an unobstructed receiver. In some embodiments the integrated circuit determines that the change in the acoustic signal is indicative of a change in acoustic leakage, wherein the expected transfer function is a ratio of the reference acoustic output signal to a reference electrical input signal for a reference test load including reference leakage.

In another aspect, armature-based receivers generally have a non-linear transfer characteristic dependent on various physical and operating characteristics of the transducer. Such characteristics include, for example, changing permeability of the armature due to a changing magnetic flux, among others. The output SPL of a receiver depends generally on the amplitude and frequency of the input signal. Receiver non-linearity tends to limit the undistorted output SPL, since higher SPL tends to aggravate distortion. Maximum output SPL is often specified for a particular level of distortion. The result is that the acoustic output of the receiver may not be an accurate reproduction of the desired acoustic output signal.

The present disclosure pertains to improving performance of an armature-based receiver by driving the receiver with a pre-distorted electrical excitation signal. FIG. 1 is a block diagram of a feed-forward system 100 that uses a computable non-linear function representing the behavior of the receiver to generate the pre-distorted electrical excitation signal. When applied to the input of an armature-based receiver, the pre-distorted electrical excitation signal improves performance of the receiver at least in part by compensating for non-linearity of the receiver including non-linearity attributable to a changing permeability of the armature. Such improved performance may result in increased SPL for a specified distortion level or in increased linearity for a specified SPL. These and other aspects and benefits are discussed further below.

Armature-based receivers refer to a class of acoustic transducers having an armature (also known as a reed) with a movable portion that deflects relative to one or more magnets in response to application of an excitation signal to a coil of the receiver. Such receivers may be balanced or unbalanced. An armature-based receiver is ideally balanced when it has no magnetic flux, or at least negligible flux, in or through the armature when the armature is in a steady-state (stationary or rest) position (i.e., in the absence of an excitation signal applied to the coil). A receiver is unbalanced when there is magnetic flux in or through a stationary armature in its nominal rest position. An armature-based receiver with only one magnet is inherently unbalanced. Generally an unbalanced receiver will have decreased output SPL for a specified level of distortion compared to a balanced receiver. This imbalance can be detected by measuring a second harmonic of the distortion of an output signal produced in response to high amplitude input or drive signals. An armature-based receiver may be unbalanced due to deviation from manufacturing tolerances or for some other reason. Also, a balanced armature-based receiver may become unbalanced upon changing the rest position of the reed between the magnets. Such repositioning of the reed rest position may occur as a result of an impact from dropping the receiver or from some other shock imparted thereto.

One source of non-linearity in armature-based receivers is attributable to changing permeability of soft magnetic components of the receiver in response to an excitation signal applied to the receiver coil. Soft magnetic components include but are not limited to the armature, the yoke or other soft magnetic parts of the receiver. Nickel-Iron (Ni—Fe) is a soft magnetic component commonly used in armature-based receivers, although other soft magnetic materials may also be used. The relationship between an external magnetizing field H induced by a current in the receiver coil and the magnetic flux density B in the armature is nonlinear, particularly when driven by excitation signals having relatively high amplitude. At some point, when the magnetizing field H is strong enough, the magnetic field H cannot increase the magnetization of the armature further and the armature is said to be fully saturated when the permeability of material is equal to 1. In some armature-based receivers, this nonlinear relationship between the magnetizing field H and the magnetic flux density B is a primary source of nonlinearity, particularly at high output SPLs. However armature-based receivers exhibit non-linear behavior even where the receiver operates over a relatively linear portion of the magnetization curve.

Another source of nonlinearity in armature based receivers is attributable to the force/deflection characteristics of the reed and diaphragm. Ideally, for small displacements, there is a linear relationship between force and deflection as specified by Hooke's law. In reality this relationship is non-linear in many receivers. Air flow in armature-based receivers may also be a source of non-linearity. For example, in order to compensate for changes in barometric pressure, a small vent is often provided in the diaphragm paddle to equalize air pressure in front and back air chambers of the receiver. However air flowing through this vent during operation encounters a varying resistance to that flow which causes distortion. There may be other sources of distortion associated with air flow in or through other parts of the receiver or the load, including air flow in or through the acoustic output port, any tubing connected to the output port, the load (e.g., a human ear), load coupling parts, among other components of the receiver. The non-linear transfer characteristic of other acoustic transducers may result from other sources that are specific to the architecture of such transducers.

During the manufacture of armature-based receivers one or more permanent magnets are magnetized by exposure to a strong external polarizing magnetic field. The magnitude of the remnant magnetic field induced in the magnets is a primary factor in the sensitivity of the receiver. Increasing this remnant field (or magnetization) of the magnets generally increases sensitivity or efficiency of the receiver but also increases distortion. An over-magnetized receiver may have a reduced output SPL for a specified distortion level compared to a receiver that is not over-magnetized. This reduced output SPL tends to increase with increasing levels of magnetization. Thus the magnetization level of a receiver requires a tradeoff between sensitivity and distortion for most use cases.

Some armature-based receivers and particularly the magnets or other permanently magnetized portions thereof are over-charged or over-magnetized, or magnetized to a greater level than best practice would normally dictate. A receiver is strongly over-magnetized when the magnetic force is stronger than a mechanical restoring force of the movable portion of the armature (i.e., the restoring force of the reed, but not the restoring force of other parts of the receiver like the diaphragm). In a strongly over-magnetized receiver, in the absence of loading by other components (e.g., the diaphragm), the reed will tend to stick to one magnet or the other if the reed is offset from its equilibrium position. Over-magnetization may be intentional or it may result from a deviation from manufacturing tolerances, or lack thereof, when charging or magnetizing the magnets or other permanently magnetized parts of the receiver.

Figure 2:
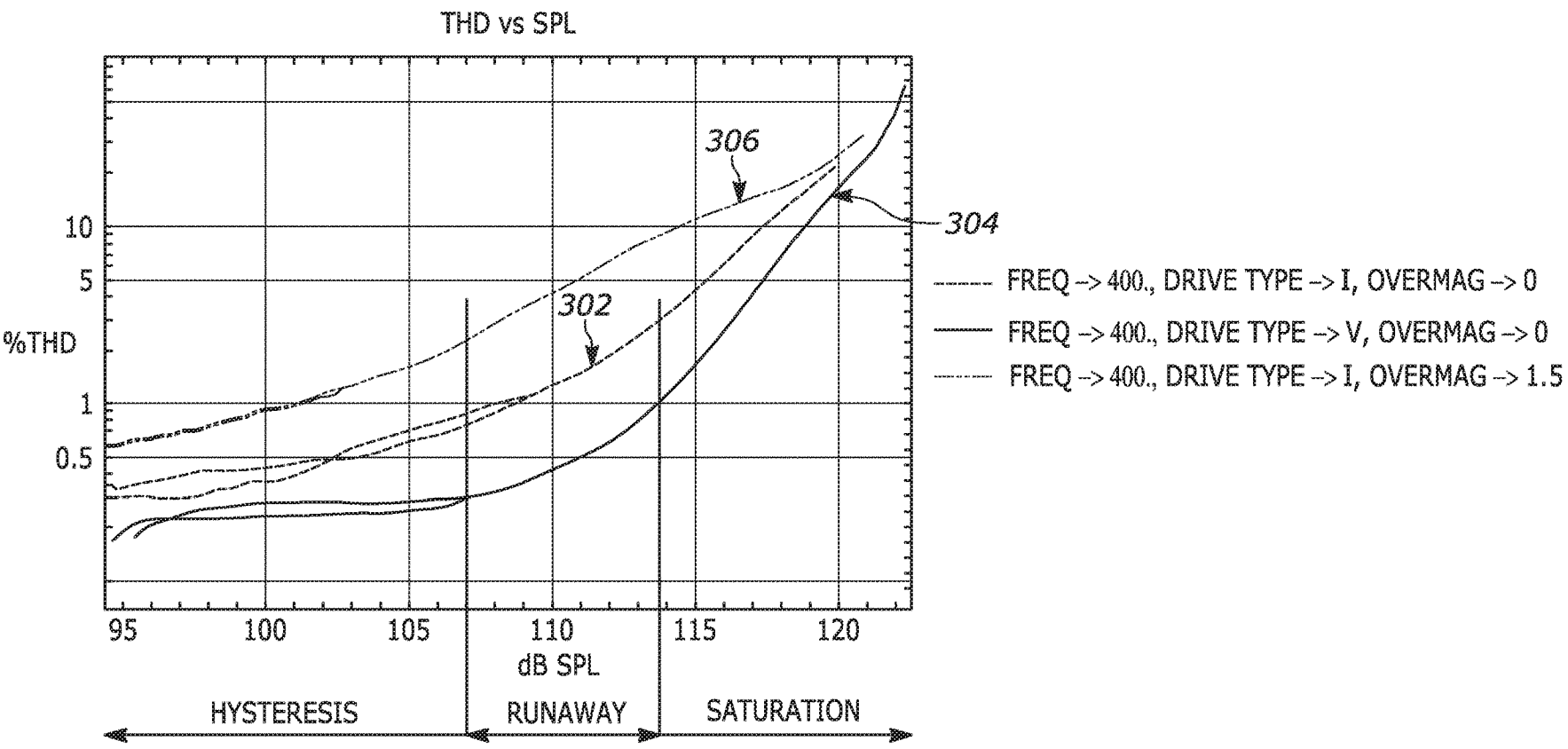
FIG. 2 is a graph of total harmonic distortion (THD) versus SPL for different magnetizations and for different types of input or excitation signals without pre-distortion.
Figure 3B:
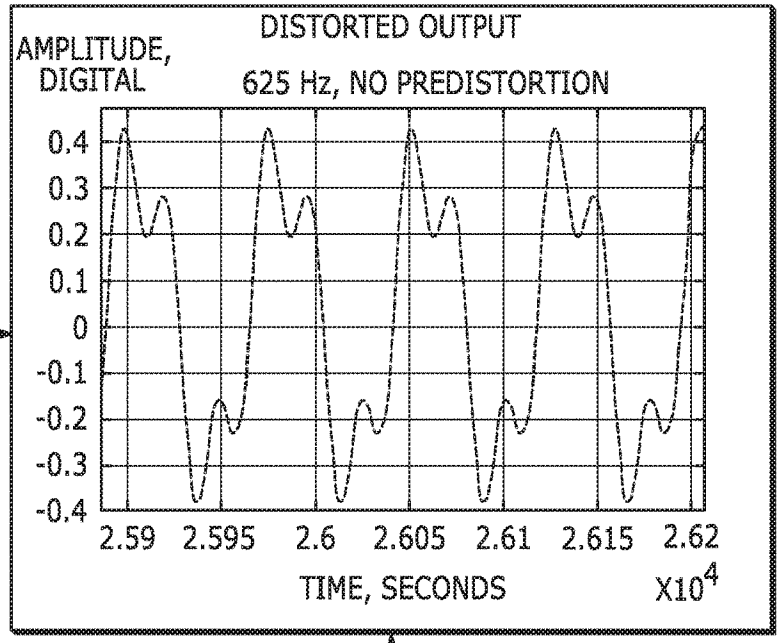
FIGS. 3A-3D are a comparative illustration of a receiver output in response to input signals with and without pre-distortion.
Figure 3A:
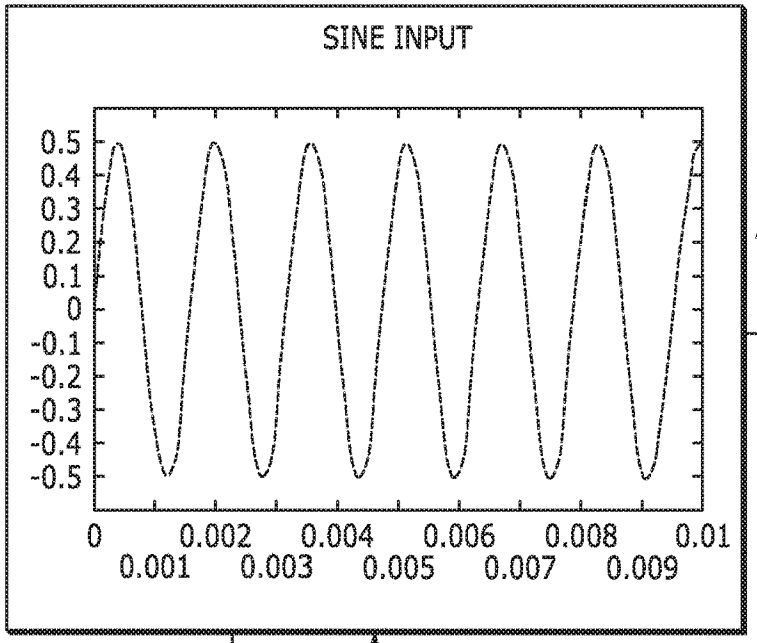
Figures 3C, 3D:
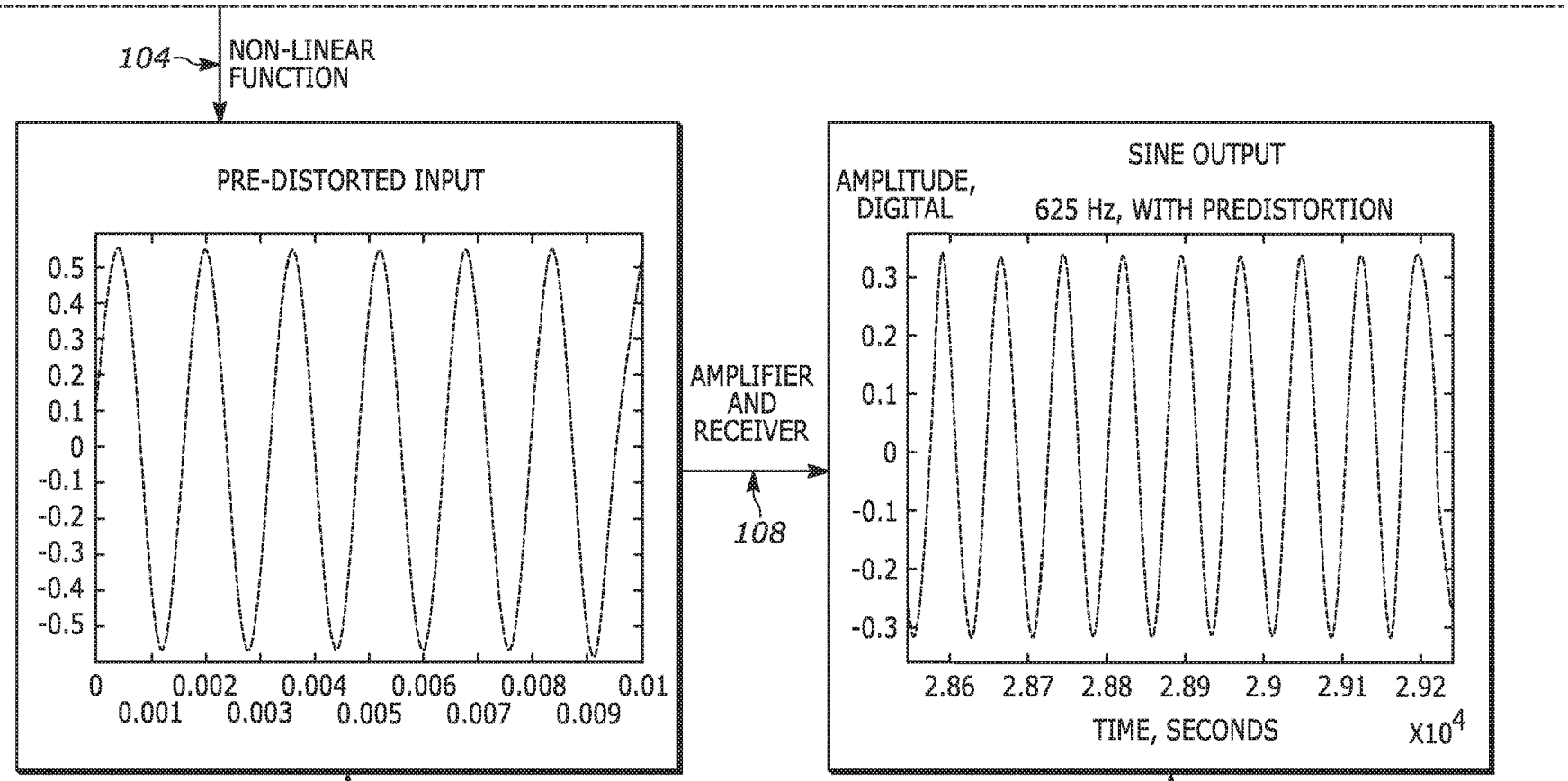

FIG. 2 is a graph of total harmonic distortion (THD) versus output SPL for different types of drive signals and for different magnetic charge levels in an armature-based receiver driven by an electrical excitation signal without pre-distortion. While 400 Hz data is shown, other frequencies or ranges may be used alternatively. Plot 302 represents THD versus SPL for a receiver without over-magnetization where the receiver coil is driven by a current signal having a frequency of 400 Hz. Plot 304 represents THD versus SPL for a receiver without over-magnetization where the coil is driven by a voltage signal having a frequency of 400 Hz. Plot 306 represents THD versus SPL for a receiver where the coil is driven by a current signal having a frequency of 400 Hz and where the armature is over-magnetized such that receiver sensitivity (in Pascal/Volt) is increased by 1.5 dB. FIG. 2 illustrates that, for a given level of distortion, e.g., five percent (5%), the output SPL for an over-magnetized receiver is less than the SPL of a receiver without over-magnetization. FIG. 2 also illustrates that a current driven receiver has lower SPL than a voltage driven receiver at the specified distortion level in the absence of pre-distortion.

In FIG. 2, the output distortion is dominated by different characteristics of the receiver over different operating regions depending on coil current, which is related to output SPL. Generally higher coil current creates more flux in the reed, producing more reed deflection and corresponding movement of the diaphragm resulting in a higher acoustic output SPL. The operating regions are described as Hysteresis, Runaway, and Saturation in FIG. 2. These regions are primarily related to the amount of flux in the reed. In the saturation region, the permeability in the armature is low and is changing rapidly, thus the output distortion increases rapidly. To maintain the output distortion at or below a specified maximum, for example, five percent (5%), the coil current must be maintained at or below a certain level. However, reducing the coil current may result in a significant reduction in SPL. In the runaway region, the permeability is higher than in the saturation region and the attraction between the reed and the magnet generally increases as the deflecting reed moves closer to the magnet. Thus there is a tendency for the reed to deflect more as the space between the reed and magnet decreases. If the magnetic force is stronger than the total mechanical restoring force of the receiver (i.e., the restoring force of the reed, the diaphragm and other parts of the receiver), the magnetic force will deflect the reed toward the magnet and the reed may ultimately stick to the magnet. As shown, runaway is a dominant source of nonlinearity at mid-drive levels. At lower coil current levels, non-linearity due to hysteresis is predominant.

Output distortion of an acoustic transducer or receiver is reduced using a feed-forward algorithm that applies a pre-distorted electrical excitation signal to an input of the receiver. The feed-forward system can be open or closed. In an open system, a pre-distorted electrical excitation signal is applied to an input of the receiver without adapting the pre-distortion to changes in a characteristic of the receiver.

In a closed system, information indicative of a change in a characteristic of the receiver is used to adaptively update the computable non-linear function used to pre-distort the input signal. The feed-forward system uses an inverse model to generate the pre-distorted electrical excitation signal. The inverse model can be created through testing or by numerically inverting a forward model. The inverse model may be efficiently implemented using a non-linear polynomial, among other computable non-linear functions. These and other aspects of the disclosure are described further herein.

The pre-distorted electrical excitation signal is an output of a computable non-linear function of an electrical input signal (x) representative of a desired acoustic output. For armature-based receivers, the pre-distorted electrical excitation signal compensates for non-linearity attributable to mechanical and magnetic hysteresis, runaway and saturation among other sources.

In FIG. 1, the system includes an input signal source 102, an input signal pre-distortion circuit 104, a battery or power supply 106, an armature-based receiver 108 with a non-linear transfer characteristic, and an acoustical load 110. The load is representative of the user's ear and any interconnecting structure like acoustic tubing and coupling devices as well as leakage and venting. The acoustic load may be different depending on the particular type of receiver and the application or implementation. A driver circuit 116 provides the pre-distorted electrical excitation signal to the receiver. The input signal source provides an electrical input signal representative of a desired acoustic output signal. The input signal could be an analog signal or a digital signal. In embodiments where pre-distortion is performed by a digital processor, an analog input signal will be converted to a digital signal. The pre-distortion circuit 104 includes an algorithm that generates a pre-distorted electrical excitation signal for the electrical input signal as discussed herein. The algorithm may be implemented at least partially as computer instructions executed by a processor 112 or by one or more separate equivalent circuits. The algorithm includes a partial or complete inverse model that describes how an input signal must be modified to achieve a desired output for a particular receiver or for a particular class of receivers. The inverse model can be based on empirical data obtained from an actual receiver or from a model of a receiver or of a class of receivers. Alternatively, the inverse model can be based on a forward model that predicts the receiver output for a given input to the receiver. The forward model can be inverted through computational techniques to directly create the inverse model. The algorithm and any model of the receiver may be stored in a memory device 114 associated with the receiver. The driver circuit 116 may be collocated with the processor and memory device on a common integrated circuit as shown, or the driver circuit may be a separate or discrete entity from the pre-distortion circuit.

In FIG. 1, the input signal source 102 may be any acoustic signal source. In one embodiment, the input signal is obtained from a microphone, for example, a condenser microphone like an electret or a microelectromechanical systems (MEMS) microphone, or from a piezo-electric device or some other acoustic transduction device. The microphone may be part of a hearing aid, a headset, a wearable device, or some other system in which the acoustic receiver is integrated or with which the receiver communicates. Alternatively, the input signal may be obtained from a media player or from some other source, which may be internal or external to the system. The battery 106 may be required in implementations where portability is desired, for example, where the receiver constitutes part of a consumer wearable product, like a hearing aid, a wireless headset and an ear piece, among other products. The pre-distortion circuit 104 including the driver circuit 116 may be integrated with the acoustic receiver 108 or with some other part of a system in which the receiver is integrated. Some implementation examples are discussed below.

FIGS. 3A-D illustrate the output of an acoustic receiver in response to a sinusoidal electrical input signal without pre-distortion compared to the receiver output in response to the sinusoidal electrical input signal subject to pre-distortion using a computable non-linear function 104 as described further herein. Application of the sinusoidal electrical input signal 132 to the input of the acoustic receiver 108 results in a distorted acoustic signal 138 at the output of the receiver. Pre-distorting the sinusoidal electrical input signal 132 using the non-linear function 104 and applying the pre-distorted electrical input signal 134 to the receiver 108 produces a relatively undistorted acoustic signal 136 at the receiver output. While the output signal 136 may have some distortion, it will have less distortion than the output signal 138.

Figure 4:
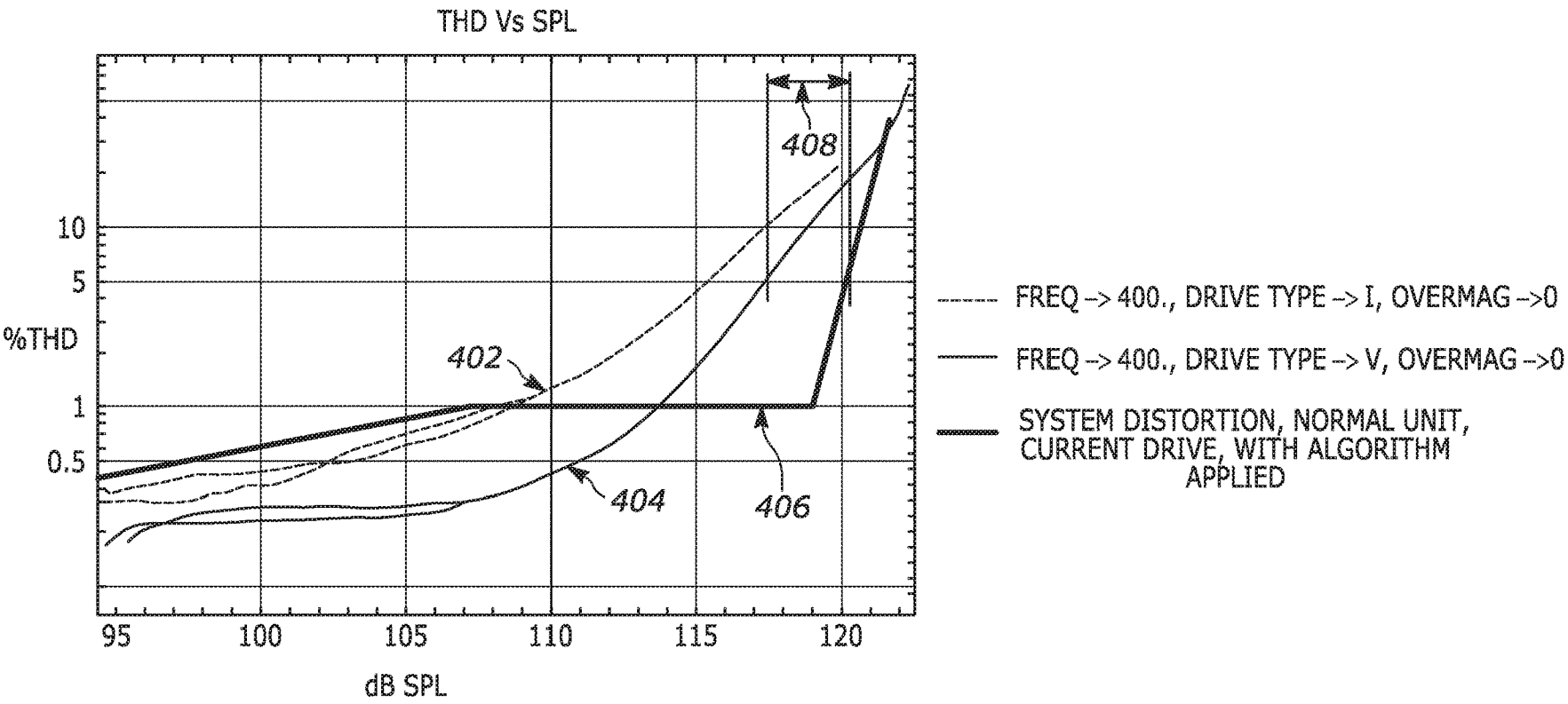
FIG. 4 is a graph of THD versus SPL for receivers driven by different types of amplifiers with and without pre-distortion.

FIG. 4 illustrates various graphs of THD versus SPL for armature-based receivers, driven by electrical excitation signals, with and without pre-distortion. While 400 Hz data is shown, other frequencies or ranges may be used alternatively. Plot 402 represents THD versus SPL for an input signal having a frequency of 400 Hz applied to the receiver by a current amplifier where the input signal is not pre-distorted. Plot 404 represents THD versus SPL for an input signal having a frequency of 400 Hz applied to the receiver by a constant voltage amplifier where the input signal is not pre-distorted. Voltage amplifiers have relatively low output impedance with respect to armature-based receivers and current amplifiers have relatively high output impedance. Many devices, particularly portable electronic devices, exist in an intermediate state were the output impedance is on the same order as the impedance of the armature receiver. Plot 406 represents THD versus SPL for a pre-distorted input signal having a frequency of 400 Hz applied to the receiver by a constant current amplifier. FIG. 4 illustrates that for five percent (5%) THD, the SPL of plot 406 is increased by approximately 3 dB (identified as improved SPL 408) relative to the SPL of plot 404. Plot 406 shows that the receiver begins to saturate at higher input current levels (corresponding to higher output SPL) when the excitation signal is pre-distorted.

Figure 5:
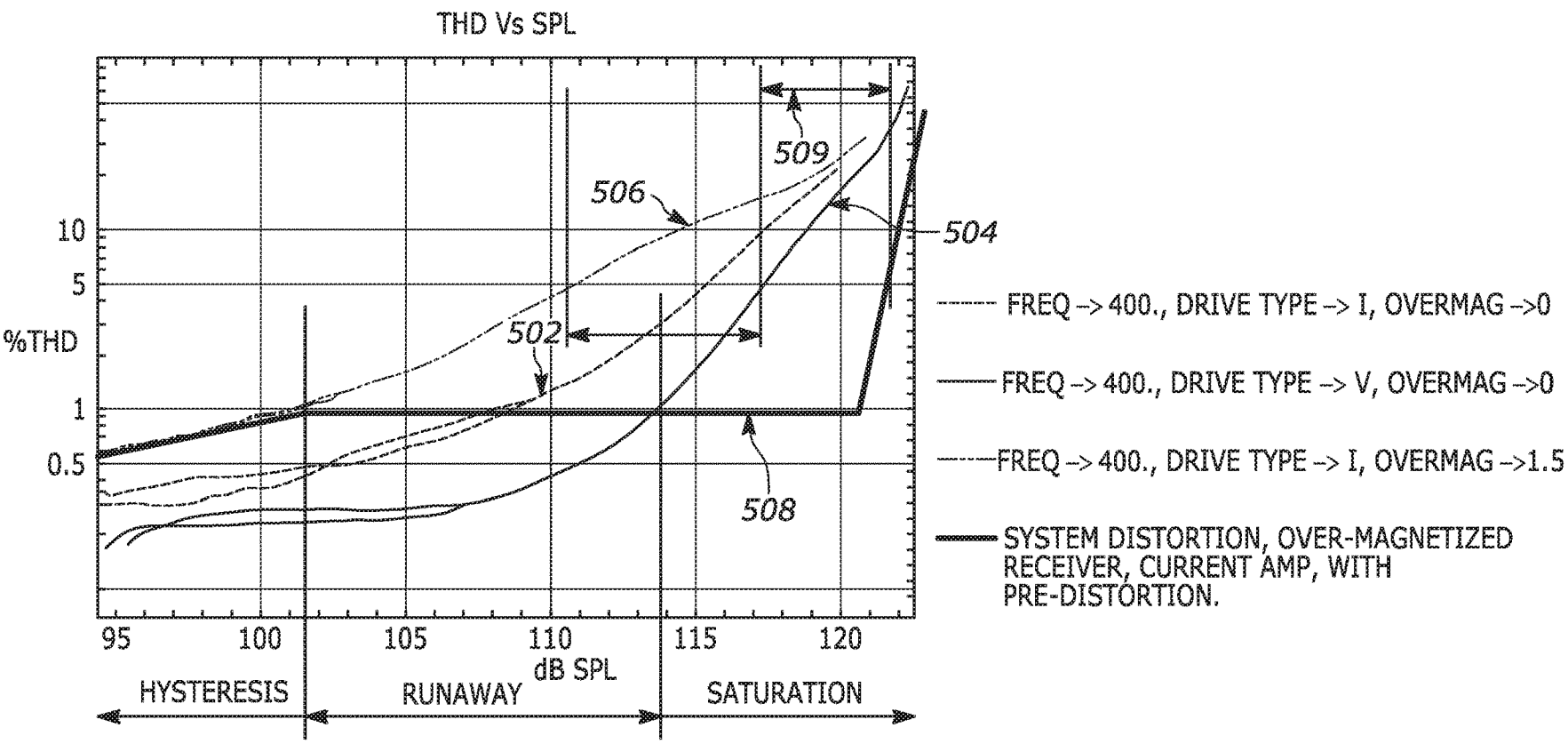
FIG. 5 is a graph of THD versus SPL for receivers driven by different types of amplifiers with and without pre-distortion, including an over-magnetized receiver.

FIG. 5 illustrates various graphs of THD versus SPL for armature-based receivers with and without over-magnetization, driven by excitation signals with and without pre-distortion. While 400 Hz data is shown, other frequencies or ranges may be used alternatively. Plot 502 represents THD versus SPL for an input signal with a frequency of 400 Hz applied to the receiver by a constant current amplifier where the input signal is not pre-distorted and the receiver is not over-magnetized. Plot 504 represents THD versus SPL for an input signal with a frequency of 400 Hz applied to the receiver by a constant voltage amplifier where the electrical input signal is not pre-distorted and the receiver is not over-magnetized. Plot 506 represents THD versus SPL for an input signal without pre-distortion and having a frequency of 400 Hz applied to a receiver by a constant current amplifier, wherein sensitivity of the receiver is increased by 1.5 dB due to over-magnetization. Plot 508 represents THD versus SPL for a pre-distorted input signal having a frequency of 400 Hz applied to a receiver by a constant current amplifier, wherein sensitivity is increased by 1.5 dB due to over-magnetization. FIG. 5 illustrates that for five percent (5%) THD, the output SPL of plot 508 is increased by approximately 4 dB (identified as improved SPL 509) relative to the output SPL of plot 504. Plot 508 shows that the receiver begins to saturate at higher input current levels (corresponding to higher output SPL) when the excitation signal is pre-distorted despite the receiver being over-magnetized and despite being driven by a relatively constant current amplifier. This result is contrary to what is suggested by plots 502 and 506, which show a tendency for the output SPL to decrease when the receiver is driven by a constant current amplifier or when the receiver is over-magnetized, respectively.

Figure 6:
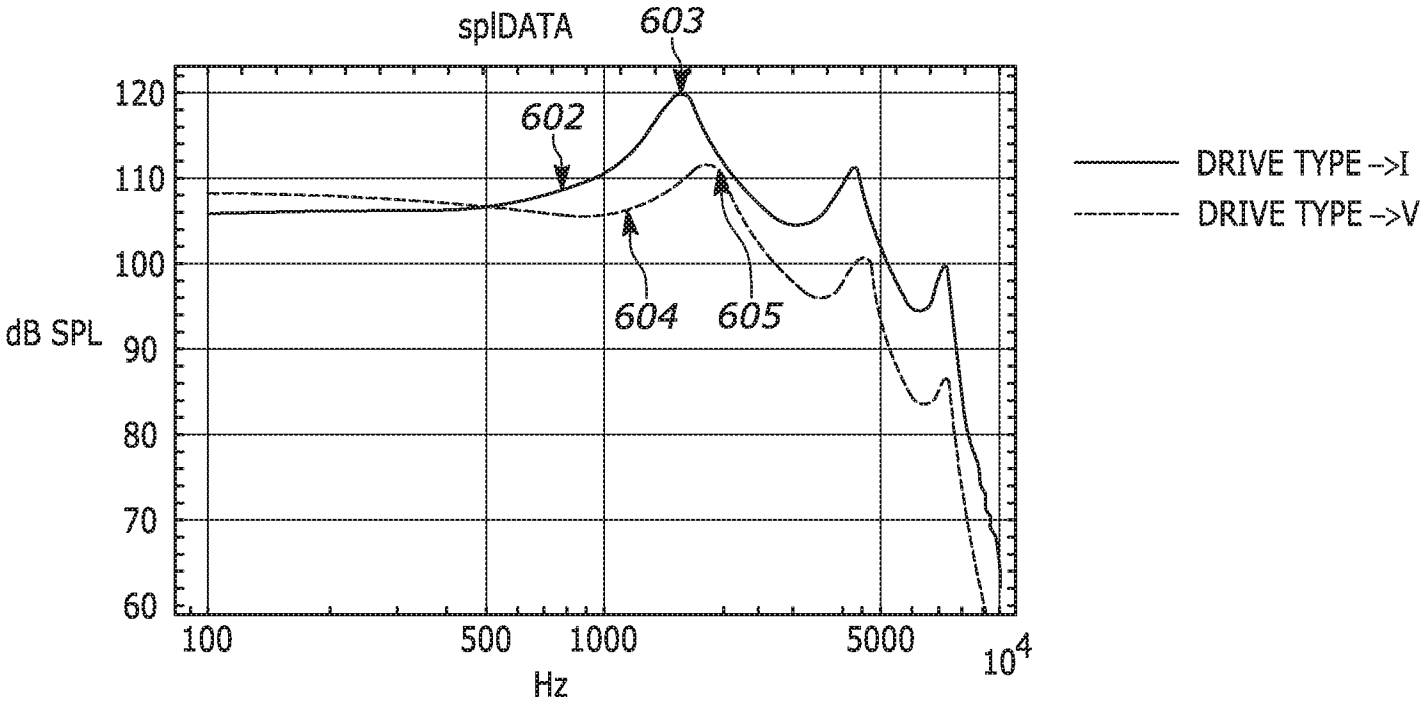
FIG. 6 illustrates the frequency response of a receiver driven by different types of amplifiers.

FIG. 6 is a graph of output SPL versus frequency for an armature-based receiver for different types of drive signals. Plot 602 represents SPL versus frequency when the receiver is driven by a constant current source and plot 604 represents SPL versus frequency when the receiver is driven by a constant voltage source. The frequency response of the output 602 produced by the current source is generally more flat than the output 604 produced by the voltage source. At frequencies greater than about 500 Hz, FIG. 6 also illustrates that SPL is greater when the receiver is driven by the constant current source compared to when the receiver is driven by the constant voltage source. A first peak 603 and 605 indicates the frequency of the primary mechanical resonance of the respective plots 602 and 604. The other peaks represent other resonant frequencies of the receiver. The frequency of the primary mechanical resonance of the receiver depends on the mechanical stiffness of the system (e.g., the reed and suspension in an armature-based receiver) and on the moving mass of the mechanical system (e.g., reed, diaphragm, drive rod and suspension in an armature-based receiver). More specifically, the resonance frequency is proportional to the square root of a ratio of the mechanical stiffness k to moving mass m (sqrt(k/m)). In FIG. 6, the primary mechanical resonance of plot 602 is about 1700 Hz and the primary mechanical resonance of plot 604 is about 1900 Hz. Generally, a higher negative stiffness tends to lower the resonant frequency of the receiver, whereas an increased mechanical restoring force (i.e., positive stiffness) of the receiver tends to increase the resonant frequency of the system. Negative stiffness refers to the tendency of the magnetic force to counteract the mechanical restoring force of the reed.

Generally, a pre-distorted electrical excitation signal is generated by applying an electrical input signal (x) representative of a desired acoustic output to a computable non-linear function before the pre-distorted electrical excitation signal is applied to the acoustic receiver. The function modifies the input signal to provide a desired acoustic output at an acoustic output port of the receiver. A computable function is one for which there exists an algorithm that can produce an output of the function for a given an input within the domain of the function. The computable non-linear function could be embodied as a continuous function or as a piecewise linear function. A piece-wise linear function could be based on a look-up table where linear interpolations are used to identify values between data points in the table. Other curve fitting schemes may be used to generate linear or nonlinear functions that approximate a data set representing an inverse model suitable for distorting an input signal.

In one embodiment, the computable non-linear function is any function that can be approximated by a rational polynomial. Such functions include polynomials, hyperbolic and inverse hyperbolic functions, logarithmic and inverse logarithmic functions, among other function forms. These and other functions may be approximated by a summation of a limited set of terms having odd or even exponents (e.g., a truncated Taylor series) as is known generally. Rational polynomial and polynomial functions are readily and efficiently implemented by a digital processor. In other embodiments, other computable non-linear functions may be used. Such other functions may have negative exponents, exponents that are less than unity, or non-integer exponents, a set of orthogonal functions, an inverse sigmoid form or some other form. Thus many suitable functional forms will include at least one term that is proportional to $x^n$ where n is not equal to unity or the value of one (1). The form of the computable non-linear function and parameters thereof (e.g., number of terms, order, coefficients, etc.) required for adequate compensation will depend in part on the particular receiver, the particular application or use case, and on the desired output.

In one embodiment, the non-linear function is a polynomial having the following general form:

$$=k_1x+k_2x^2+k_3x^3+\ .\ .\ .\ +k_nx^n=k_1x+k_2x^2+k_3x^3+\ .\ .\ .\ +k_nx^n y=k_1x+k_2x^2+k_3x^3+\ .\ .\ .\ +k_nx^n \quad \text{Eq. (1)}$$

In Equation (1), the variable x is an electrical input signal representative of the desired acoustic signal and the function parameters are coefficients. The electrical input signal could originate from a microphone associated with a hearing-aid, from an audio source like a media player, or from any other source. The coefficients $k_n$ represent constants for the $n^{th}$ order terms in the series. The signal resulting from the summation of terms is non-linear and the terms and polynomial coefficients are selected to compensate for non-linearity of the acoustic receiver as discussed below. Odd ordered terms generally compensate for symmetric non-linearity and even ordered terms generally compensate for asymmetric non-linearity. Thus the polynomial of Equation (1) compensates for both symmetric and asymmetric non-linearity. In armature-based receivers symmetric non-linearity may be attributable to magnetic saturation of the receiver, air noise, receiver suspension, among other characteristics, and asymmetric non-linearity may be attributable to reed imbalance, receiver suspension, among other receiver characteristics.

The polynomial of Equation (1) compensates most effectively for non-linearity at frequencies below the primary mechanical resonance of the receiver where the frequency response is substantially flat (as shown in FIG. 6). Also, below the primary resonance, the sensitivity of the receiver with respect to input current is similar. In other words, the coefficients in Equation (1) are effective in reducing distortion on frequencies below the primary mechanical resonance of the receiver. For frequencies above the primary resonance, the coefficients in the polynomial of Equation (1) are more strongly frequency-dependent. A generalization of Equation (1) is to replace the coefficients in Equation (1) with frequency-dependent transfer functions (e.g., time-domain filters) as follows:

$$y=(h_1(x))+(h_2(x))^2+(h_3(x))^3+\ .\ .\ .\ +(h_n(x))^n \quad \text{Eq. (2)}$$

In Equation (2), $h_n(x)$ is a time-domain filter wherein the output of the filter $h_1$ (x) is added to the square of the output of filter $h_2(x)$ and to the cube of filter $h_3(x)$, and so on where the filter powers are taken on a per sample basis. It will be appreciated that a special case of Equation 2 is where one or more of the time-domain filters are identical. In such a case, efficiencies can be realized by processing the input signal through identical filters only once and then simply exponentiating those outputs to different degrees before adding. Equation (2) extends the applicability of polynomial-based compensation to higher frequencies.

Equation (2) could be implemented using an Autoregressive Moving-Average (ARMA) filter. An ARMA filter is a digital filter that uses present and past values of the input signal and past values of the output signal to compute a current output signal. The same input is applied to each filter, but the filter outputs are different, due at least in part to the order of various terms. A typical ARMA filter implementation is as follows:

$$y[n]=b_0x[n]+b_1x[n-1]+b_2x[n-2]+a_1y[n-1]+a_2y[n-2] \quad \text{Eq. (3)}$$

In Equation (3), x[n] is the filter input, y[n] is the filter output, and the constants $a_n$ and $b_n$ are filter parameters, where n=0, 1, 2 . . . .

For many applications, polynomials with frequency independent terms like Equation (1) will provide reasonably good compensation for receiver non-linearity, since much of the energy in the input signal is below the primary mechanical resonance of the receiver. In one particular implementation, the non-linearity of an armature-based receiver is compensated by modifying an electrical input signal applied to the receiver coil by a current amplifier with the following polynomial:

$$y=k_1x+k_3x^3+k_5x^5+\ldots+k_{2n+1}x^{2n+1} \quad \text{Eq. (4)}$$

Figure 7:
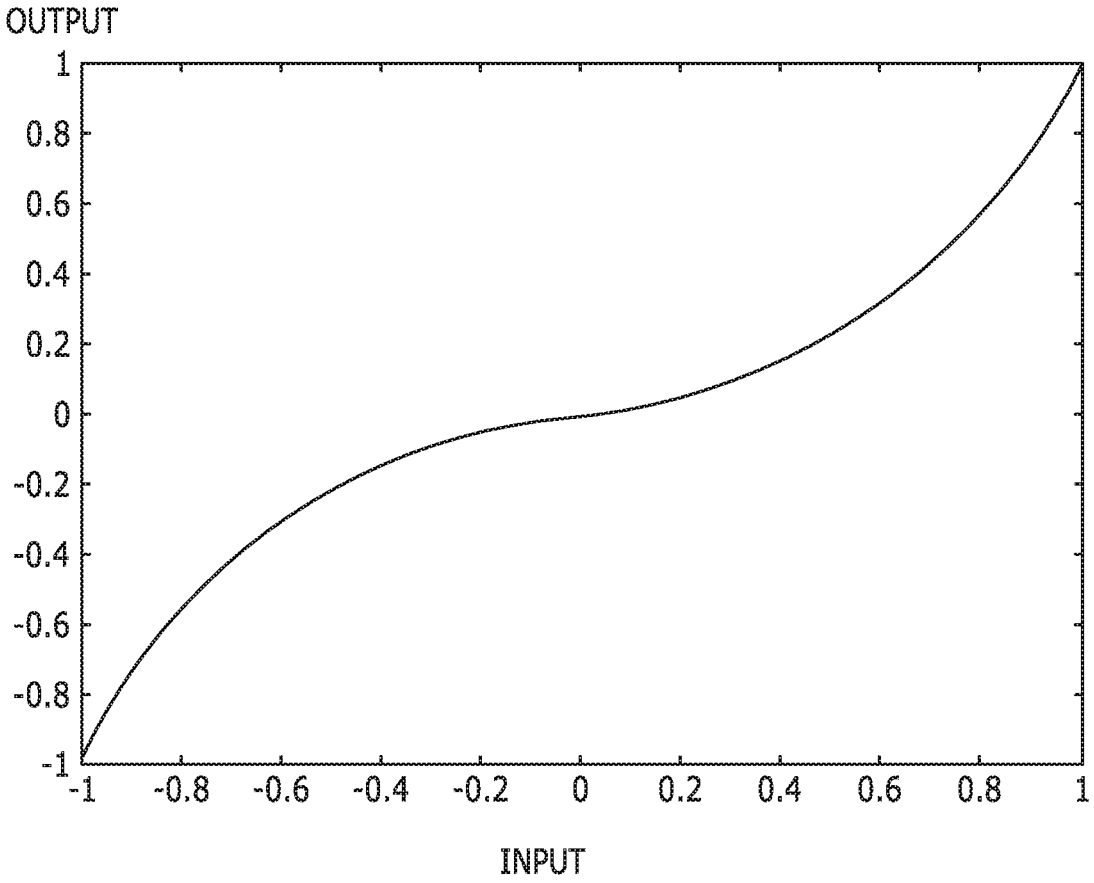
FIG. 7 is a graph of a computable non-linear function having an inverse sigmoid form.

In Equation (4), the variable x represents an electrical input signal representative of a desired acoustic output. The coefficients $k_n$ for the odd order terms compensate for predominant components of non-linearity of the receiver, mostly at frequencies below the primary mechanical resonance of the receiver. As discussed, odd order terms, for example, the $1^{st}$, $3^{rd}$ and $5^{th}$ order terms in Equation (4), compensate for symmetric non-linearity of the acoustic receiver. In armature-based receivers, symmetric non-linearity is attributable to magnetic saturation among other characteristics, some of which were discussed above. Thus the polynomial in Equation (4) compensates for non-linearity in the saturation region illustrated in FIG. 4. The polynomial of Equation (4) will provide reasonably effective compensation, particularly at higher magnitude or amplitude drive levels. For some armature-based receivers the coefficients for even ordered terms will be small or negligible. In some implementations, higher order terms may be eliminated with less but still noticeable improvement. In other implementations, compensation may be improved by adding one or more additional terms to the polynomial. FIG. 7 illustrates a graph of an odd polynomial represented by Equation (5) below:

$$y=0.28x+0.63x^3+0.10x^5 \quad \text{Eq. (5)}$$

where y is the "Output" and x is the "Input".

Generally, the computable non-linear function is selected and optimized for a particular receiver or for a class of receivers and in some implementations for particular processor. The term "optimize" or variations thereof as used herein means the selection of a computable non-linear function or parameters of such a function tending to reduce the output distortion of the receiver, at a specified SPL, when the receiver is driven by an electrical input signal that is pre-distorted by the function compared to the output distortion that would be obtained at the specified SPL when the receiver is driven by the electrical input signal without pre-distortion. Alternatively, optimization may also mean the selection of a computable non-linear function or parameters of such a function tending to increase SPL output of the receiver, for a specified distortion level, when the receiver is driven by an electrical input signal that is pre-distorted by the function compared to the SPL that would be obtained at the specified distortion level when the receiver is driven by the electrical input signal without pre-distortion. Optimization may also mean the selection of a computable non-linear function or parameters of such a function that satisfy a power consumption or processing and memory resource utilization constraints, among other considerations.

Optimization of the computable non-linear function may take many forms, including one or more of the selection of the function form or the selection of function parameters. Polynomial functions can be computed efficiently and selection of form of the computable non-linear function (e.g., odd or even order polynomial, approximated hyperbolic function . . . ) may be dictated, at least in part, by the receiver type or the predominant distortion (symmetric, asymmetric, or both) that requires compensation. Optimization may also occur by selection of a set of one or more parameters of the computable non-linear function. In embodiments where the computable non-linear function is approximated by a summation of a series of terms, the function may be optimized by selection of the order or coefficients of the function. These forms of optimization may be implemented readily and efficiently using a digital processer, for example, by implementing one or more iterative algorithms, examples of which are described below.

In some embodiments, the computable non-linear function (e.g., the polynomials in the examples above) are determined experimentally or using a numerical model of the acoustic receiver. A mathematical algorithm or some other iterative scheme may be used to select the form of the computable non-linear function and to select parameters of the function. Generally the form of the computable non-linear function is selected initially. A trial and error approach may be used to select the computable non-linear function that best compensates for a predominant distortion in a particular type of receiver or for a particular use case. Such an approach may be implemented by generating a pre-distorted excitation signal using different non-linear function forms, applying the pre-distorted excitation signal to a receiver, and evaluating the receiver output. Machine learning techniques or other mathematical algorithms are suitable for this purpose and may be used to facilitate form selection. The function form that results in the most desirable receiver output may be selected. Other than distortion compensation efficacy, the form of the function may be selected based on processor or memory resource requirements. Constraints may be imposed to ensure that the selection of the function does not result in undesirable results.

Upon selection of the form of the computable non-linear function, parameters of the function may be selected or optimized, through an iterative process, to improve performance of the receiver. For non-linear functions that comprise a summation of a series of terms, the order of and coefficients for the terms in the series among other parameters may be optimized through one or more iterative processes. To optimize a set of one or more parameters for a computable non-linear function, a known input signal, like a sinusoid, is pre-distorted using a previously selected non-linear function with a preliminary set of parameters. For example, a preliminary set of parameters could be coefficients or exponents of the polynomial of Equation (5). The preliminary set of parameters used during the first iteration may be based on a best guess, empirical data, or on parameters used previously for a similar receiver. The pre-distorted excitation signal is then applied to the input of a receiver or to a numerical model of the receiver and then the distortion of the resulting acoustic output of the receiver is evaluated. In a subsequent iteration, a new intermediate set of parameters is selected or determined based on the output distortion. The process iterates by making incremental changes to one or more parameters of the selected function based on a measure of the output distortion of the receiver until a desired output is attained. Considerations other than receiver output may also bear on the selection of the function parameters. For example, the form of the function or the number of terms in a series may impact the computational load on processing and memory resources. Additional terms in a series may provide a more linear output, or could be used to reduce clipping of the amplifier. Thus constraints may be imposed to ensure that the selection of the function parameters do not result in undesirable results.

The distortion of the acoustic output of the receiver may be determined using known techniques. For example, the distortion of the output signal may be estimated by computing its Total Harmonic Distortion (THD). Another approach is to compute THD+Noise for the output. Other measures of distortion may also be used. Algorithms for implementing these and other techniques for determining the distortion or linearity of an output signal are well known and not discussed further herein.

One such iterative methodology suitable for selecting or optimizing parameters of a computable non-linear function is a gradient descent algorithm. Other algorithms may also be used. These algorithms generally converge on a local minimum of the function. A minimum is identified when a rate of change of output signal distortion, with respect to some characteristic of the function, approaches zero. In some implementations however it may not be necessary to iterate until a minimum is reached. For example, the non-linear function could be optimized for a specified level of distortion without attaining a local minimum. The optimized function or a set of parameters associated with the function may be stored in a memory device associated with the acoustic receiver for subsequent use.

Optimization of the computable non-linear function may be implemented by a test system after production of the acoustic receiver as discussed in connection with the system 800 of FIG. 8. In other embodiments however the optimization is implemented by a processor or integrated circuit associated with the receiver as discussed below. The system 800 optimizes a computable non-linear function for an acoustic receiver having an initial operating characteristic or for a receiver or a class of receivers having the initial characteristic. The system 800 includes a function or inverse model generator 802 that optimizes the computable non-linear function until the output distortion of the receiver satisfies a criterion (e.g., a specified output distortion level). As suggested above, the inverse model generator may select the computable non-linear function form or select parameters of the function or both. As discussed above, the approach to selecting the form of the function will generally be different than the approach to selecting parameters of the function. The system 800 also includes a pre-distorted electrical excitation signal generator 804 that generates a pre-distorted electrical excitation signal by applying an input signal representative of the desired acoustic output to the non-linear function generated by the inverse model generator. The input signal is generated or provided by an input signal source 806. The input signal may be a sinusoidal test signal. During optimization, pre-distorted electrical excitation signals are iteratively applied to the receiver 810 and the function is iteratively updated based on iterative measures of the output distortion until the output distortion of the receiver satisfies some criterion.

Figure 8:
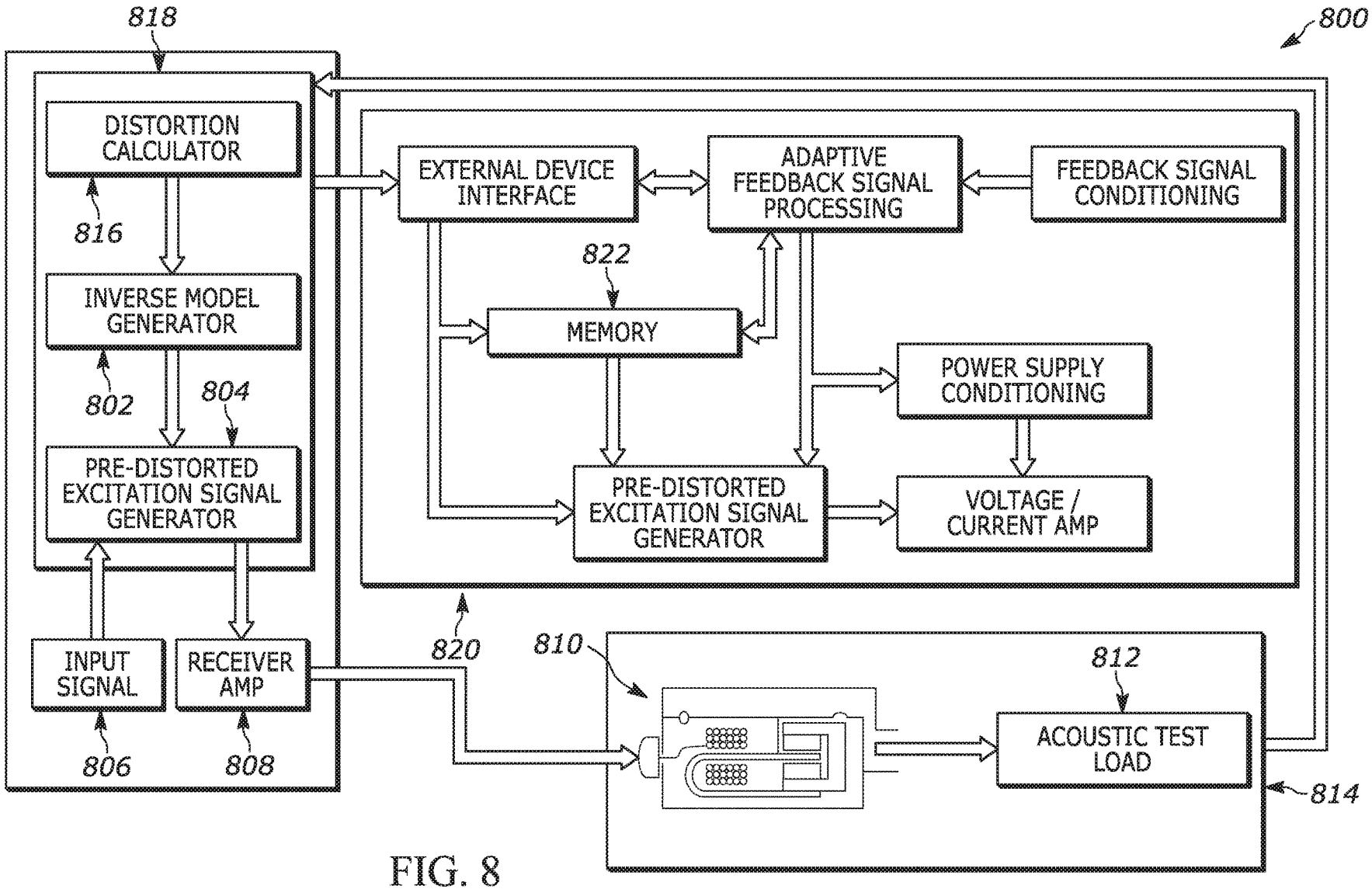
FIG. 8 is a test system for determining parameters for a non-linear function.

In FIG. 8, the pre-distorted electrical excitation signal is applied to the receiver 810 by a current or voltage amplifier 808. The acoustic output of the receiver is input to an acoustic test load 812 that models an acoustic load of the receiver. Such a load may represent acoustic tubing, the user's ear anatomy, acoustic leakage, among other load variables, some of which are discussed elsewhere herein. A microphone converts the acoustic output signal to an electrical signal that is fed back to a distortion calculator 816. The microphone may be part of the receiver or test load. The distortion calculator 816 calculates the distortion of the electrical signal provided by the acoustic test load 812 as discussed above. The result of the distortion computation is provided to the inverse model generator 802 for optimizing the non-linear function in the next iteration. The process iterates until the receiver output satisfies a specified criterion. After selection or optimization of the computable non-linear function, the non-linear function is stored in memory on, or associated with, the receiver for subsequent use as discussed below.

In one implementation, the inverse model generator 802, the pre-distorted excitation signal generator 804, and the distortion calculator 816 are implemented by a digital processing device 818. While the inverse model generator, the pre-distorted signal generator, and the distortion calculator are schematically illustrated as separate functions, these functions may be implemented by executing one or more algorithms on one or more processors represented schematically as processor 818. In some embodiments, the input signal used to optimize the non-linear function is also generated by the processor 818 and thus the input signal source 806 may also be implemented as a signal generating algorithm, like a sine wave generator, executed by the processor. Alternatively, the input signal may be obtained from an external source.

In another implementation, the receiver 810 and the test load 812 of FIG. 8 are represented by a numerical model representative of a particular receiver or a class of receivers. The model is illustrated schematically at 814. According to this embodiment, the computable non-linear function is determined by iteratively applying intermediate pre-distorted electrical excitation signals to the model of the receiver and the load. The model 814 outputs a signal representative of the acoustic output of the modeled receiver in response to application of a pre-distorted input signal to the model. The output of the model 814 is provided to the distortion calculator 816 for analysis. The distortion calculator determines the distortion of the output signal fed back from the model, and the result is provided to the inverse model generator for the next iteration. In this embodiment, the amplifier 808 is a virtual device that may be implemented by the processor 818. The numerical model 814 of the receiver and load may also be implemented by the processor 818. Numerical models based on analogous electrical equivalents of receivers are known generally and a representative model of an armature-based receiver is described below with reference to FIGS. 11A-B.

After selection or optimization of the computable non-linear function, the function is written to a memory device on, or associated with, the receiver for end-use. The memory device may be a discrete component or it may be part of an integrated circuit, like an ASIC, disposed in or on the receiver. The memory device or integrated circuit may also be located on another component used with the receiver or in or on a device or system with which the receiver is integrated. Such a device or system may be a hearing instrument, like a set of headphones or a hearing-aid device, among other examples discussed herein. In FIG. 8, the processor 818 writes the computable non-linear function or function parameters to a memory device 822, which may be part of an integrated circuit 820 associated with the receiver.

In some implementations, an alternative set of parameters is determined for a characteristic of the acoustic receiver that is different than the initial characteristic. The alternative set of one or more parameters are optimized by iteratively applying intermediate parameters to the receiver with the different characteristic and assessing the output distortion as discussed above. A parameter model representative of the alternative set or sets of parameters is stored in the memory device associated with the receiver in anticipation of changes in a characteristic of the receiver while in use by the end-user. The parameter model generally relates the alternative set or sets of parameters to information indicative of corresponding characteristics of the receiver. The alternative sets of parameters may be generated by the system 800 of FIG. 8 or by a processor or integrated circuit associated with the receiver as discussed in connection with FIG. 9. The parameter models may be embodied as one or more look-up tables or as one or more continuous or piece-wise linear functions. According to this aspect of the disclosure, operational conditions indicative of a change in characteristic or configuration of the receiver are monitored during operation of the receiver, in some cases using sensors located on or near the receiver. Upon detecting a condition indicative of a change in a characteristic of the receiver, information indicative of the change is fed back to a processor associated with the receiver and the parameters are updated using the parameter model to compensate for the change. Some examples of the use of the alternative parameters are discussed below. More generally, this approach may be used to select a different non-linear function form or parameters of the selected function to compensate for a change in a characteristic of the receiver.

In use, the acoustic receiver having a non-linear transfer characteristic is associated with an electrical signal conditioning apparatus including a processor that generates the pre-distorted electrical excitation signal by applying an electrical input signal (x) representative of a desired acoustic output to a computable non-linear function optimized for the receiver. As discussed above, the pre-distorted electrical excitation signal is the output of the non-linear function. In one implementation, the non-linear function includes at least one term that is proportional to $x^n$, where n is not equal to unity. Generally, when applied to an input of the receiver having a non-linear transfer characteristic, the pre-distorted electrical excitation signal improves the performance of the receiver. In armature-based receivers, an acoustic output of the receiver is produced by deflecting the armature relative to one or more magnets upon applying the pre-distorted electrical excitation signal to a coil of the receiver. In one embodiment, for a specified distortion level, a sound pressure level of the acoustic output produced in response to the pre-distorted electrical excitation signal is greater than a sound pressure level that would be produced, at the specified distortion level, in response to the electrical excitation signal without pre-distortion. In another embodiment, for a specified acoustic sound pressure level, the acoustic output produced in response to the pre-distorted electrical excitation signal has less distortion than an acoustic output that would be produced in response to the electrical excitation signal without pre-distortion. In other implementations, the pre-distorted electrical excitation signal provides some other beneficial effect, like efficient processing and memory resource utilization.

Figure 9:
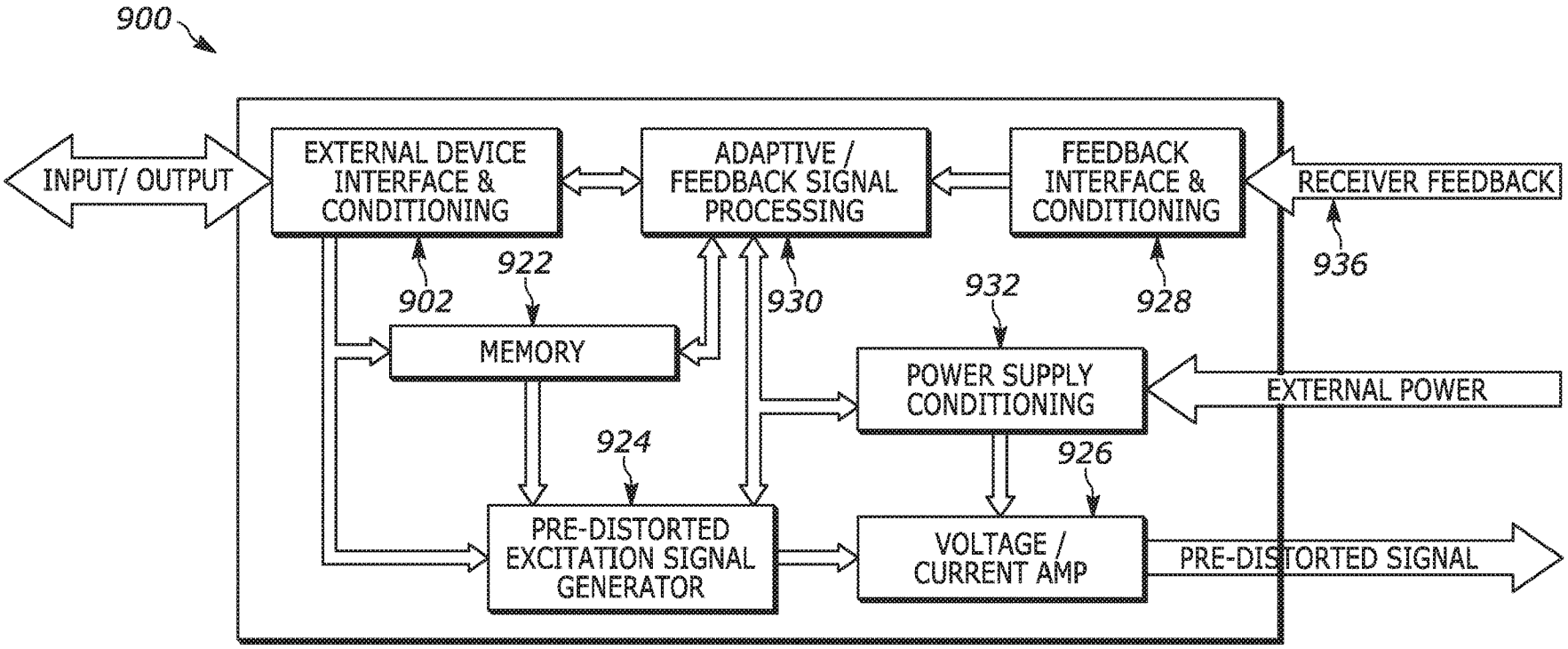
FIG. 9 is a schematic block diagram of an integrated circuit used in combination with a receiver.

FIG. 9 illustrates an integrated circuit (IC) 900 for use in combination with an acoustic receiver. While FIG. 9 illustrates different features and functions on a single circuit, for example, an ASIC, these features and functions may be performed by multiple circuits in alternative embodiments. The one or more discrete circuits or ASICs are located in or on a receiver or a system with which the receiver is integrated, examples of which are discussed herein. The IC includes an external device interface 902 that enables communications between the receiver and external devices like system 800 of FIG. 8, hearing-aid circuits, and circuits of audio headsets and other audio systems with which the receiver is integrated. For example, the system of FIG. 8 may communicate the computable non-linear function, function parameters, parameter models, numerical models of the receiver, and other information to a memory device 922 via the interface 902 in FIG. 9. An input signal representative of the desired acoustic output may also be communicated to the integrated circuit via the external device interface prior to generation of the pre-distorted electrical excitation signal. Such an input signal may originate from a microphone or from a media content source or from some other audio signal source. The integrated circuit may also communicate information to other circuits of the receiver or system with which the receiver is integrated via the external device interface. For example, a hearing instrument may have a separate processor with which the circuit 900 communicates. The external device interface 902 is also representative of signal conditioning that may be performed on signals received by, and transmitted from, the circuit 900. Such conditioning may include analog-to-digital A↔D conversion, signal format conversion (e.g., PDM↔PCM), and other signal conditioning.

FIG. 9 also illustrates a pre-distorted excitation signal generator 924 that generates the pre-distorted electrical excitation signal by applying the input signal representative of a desired acoustic output to the computable non-linear function. The signal generator 924 of FIG. 9 is similar to the generator 804 of the system of FIG. 8. As suggested, the input signal representative of the desired acoustic output may be input at the external device interface 902 by other circuits of the device or system with which the receiver is integrated. In FIG. 9, the pre-distorted electrical excitation signal is provided to an amplifier 926 for subsequent input to the receiver. The amplifier 926 is shown as part of the integrated circuit, but in other embodiments, the amplifier may be a discrete circuit or device disposed between the integrated circuit and the receiver. The amplifier may be embodied as a voltage amplifier or a current amplifier. A current amplifier may be embodied as a current-in/current-out amplifier or a transconductance amplifier having voltage input and a current output.

In some embodiments, a processor associated with the receiver generates an updated computable non-linear function to accommodate a change in characteristic of the receiver. The non-linear function is updated with an alternative set of parameters. For this purpose, a condition of the receiver indicative of a change in characteristic is sensed and information indicative of the change is fed back to the processor. Such conditions of the receiver can be detected by monitoring or sensing changes in receiver impedance, front volume pressure, back volume pressure, receiver output SPL, among other detectable conditions of the receiver. The processor generates an updated non-linear function, for example, by applying an updated set of parameters to the non-linear function.

In FIG. 9, for example, the integrated circuit 900 associated with the receiver includes a feedback interface and conditioning circuit 928 for receiving information from the receiver. The interface 928 is also representative of signal conditioning that may be performed on signals 936 from the receiver, including A/D conversion, signal format conversion, and other signal conditioning. The interface 928 is shown schematically separately from the interface 902, but these interfaces may be implemented as a common interface in other embodiments. The feedback interface is coupled to a processor 930 that assesses the receiver feedback and determines an updated non-linear function using models stored in memory 922. The updated non-linear function is also stored in memory.

Figure 10:
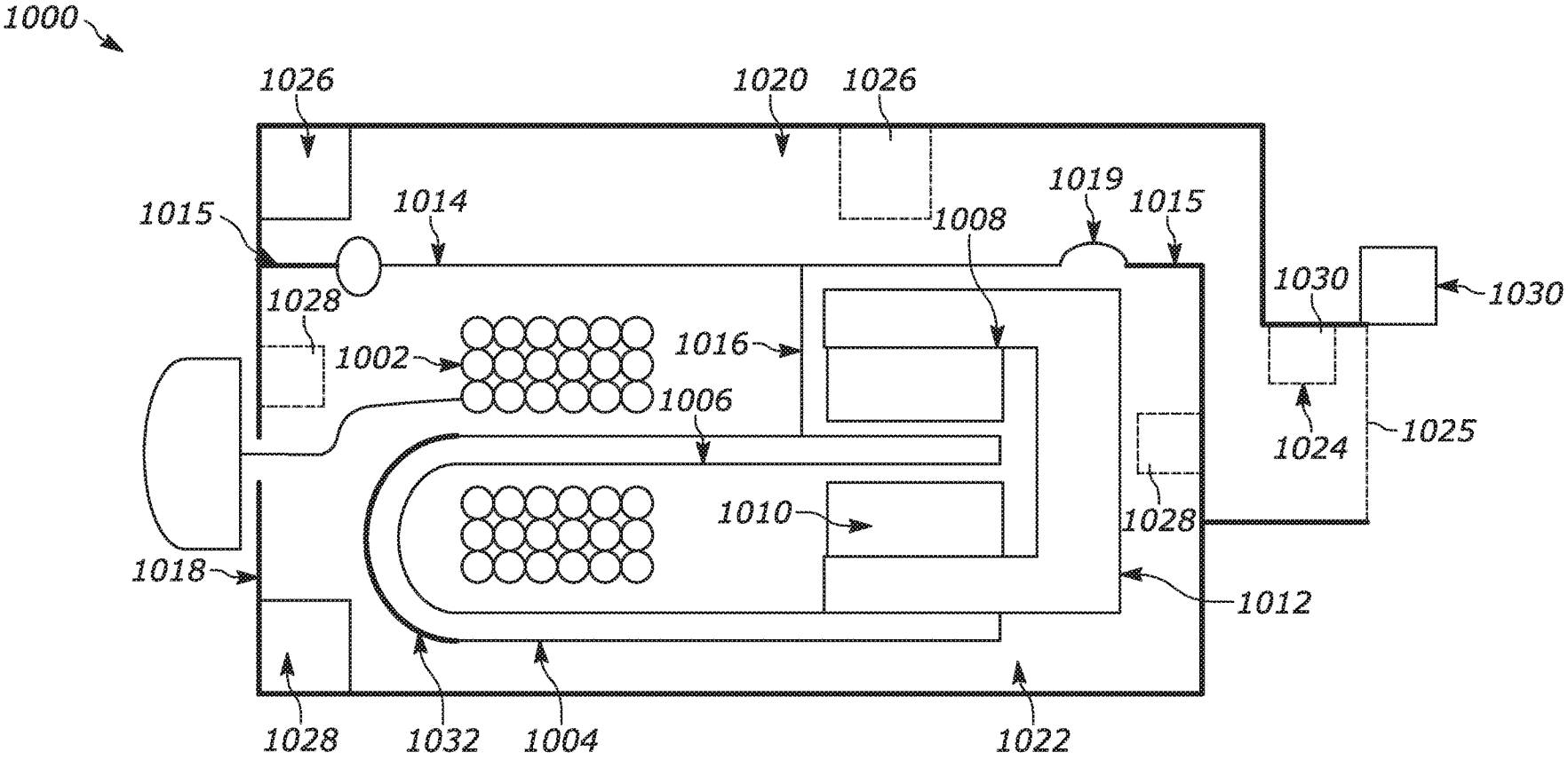
FIG. 10 is a schematic block diagram of a receiver.

FIG. 10 is a schematic block diagram of an armature-based receiver 1000 comprising a coil 1002 disposed about a portion of an armature 1004. The armature has a movable portion 1006 that deflects between magnets 1008 and 1010 upon application of an excitation signal to the coil. The magnets are retained by a yoke 1012. The movable portion of the armature is coupled to a paddle 1014 by a linkage 1016. The paddle is hinged or otherwise movably coupled to a support structure 1015 retained by a receiver housing 1018. A flexible membrane 1019 bridges a gap between the paddle and the support structure, and the combination forms a diaphragm. The diaphragm divides the housing 1018 into a front volume 1020 and a back volume 1022. Deflection of the armature moves the paddle resulting in changes in air pressure in the front volume wherein acoustic pressure (e.g., sound) is emitted through an output port 1024 of the receiver. The schematic receiver diagram of FIG. 10 is representative of any armature-based receiver architecture. For example, other receivers may have different armatures or yoke configurations, among other configurations.

As suggested above with reference to FIG. 9, in some embodiments, the receiver provides information about a changing configuration or characteristic of the receiver for which it may be desirable to update the non-linear function used to pre-distort the input signal. Some of these changing characteristics may be detected by monitoring conditions of the receiver with sensors on the receiver or in the integrated circuit, like the circuit of FIG. 9. For example, the impedance of the receiver may be monitored by sensors in the amplifier circuit or by other circuits. The monitoring of other conditions however may require additional sensors (also referred to as electro-acoustic transducers or microphones) on the receiver. In FIG. 10, for example, pressure sensors 1026 and 1028 may be used to monitor changes in air pressure in the front and back volume of the housing, and an acoustic sensor 1030 may be used to convert the acoustic output of the receiver to an electrical signal that may be analyzed for distortion and for other characteristics as discussed below. In FIG. 9, information from the receiver indicative of these and other changing receiver characteristics are illustrated schematically at 936. Some specific examples are discussed below.

Figure 13:
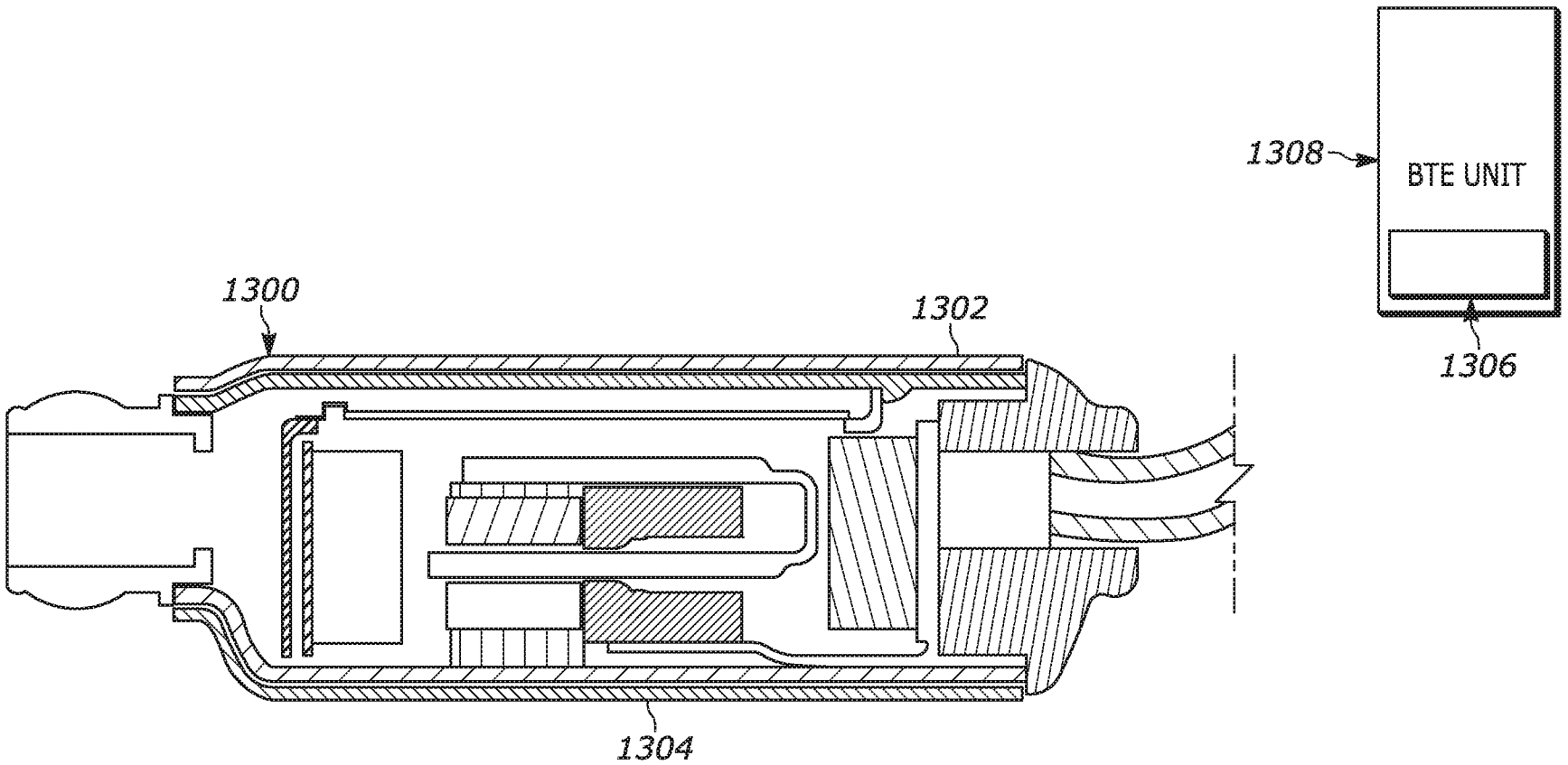
FIG. 13 illustrates a system in which an armature-based receiver is integrated.

As suggested above, some or all of the functionality of the circuits of FIG. 9 may be implemented in the receiver or in some other part of the system with which the receivers is integrated. FIG. 13 shows a receiver 1300 having the integrated circuit embodied as an ASIC 1302 disposed within a back volume 1304 of the receiver housing. More generally, the receiver 1300 could have some other form. In other embodiments, some or all of the circuit functionality may be disposed in some other part of the device or system with which the receiver is integrated. In hearing aid implementations, for example, an integrated circuit 1306 having some or all of the functionality of the circuits of FIG. 9 may be disposed in a behind the ear (BTE) unit 1308. In other implementations, some or all of these circuits may be disposed in a housing of a headphone or in a portion of some other system with which the receiver is integrated.

One circumstance that may affect receiver output is a change in the initial steady-state (i.e., rest) position of the reed between the magnets. The initial rest position of the reed is typically a balanced position but in some embodiments it may be unbalanced. Such a change in rest position of the reed may result from an impact or other shock to the receiver. As discussed above, it may be desirable to update the computable non-linear function to accommodate the change in reed rest position. One approach, among others, is to update the function by applying an alternative set of parameters to the function. Table 1 below shows an initial set of polynomial coefficients for an initial rest position of the reed identified as position $x_0$. According to this example, alternative sets of optimized parameters may be computed for different reed rest positions (e.g., $+/-x_1$, $+/-x_2$ . . . ) relative to the initial rest position (i.e., $x_0$). The alternative parameters may be computed by the system of FIG. 8 for different reed rest positions using an iterative approach described herein. Different reed rest positions may be obtained by applying different +/− DC bias voltages to the magnetic circuit of the receiver. Alternatively, the alternative sets of parameters may be determined by iteratively applying intermediate pre-distorted excitation signals to a model of the receiver with different reed rest positions using a virtual amplifier. The optimized set of alternative parameters may be tabulated for each reed position as follows:

TABLE 1

| Reed Rest Position | Polynomial Parameters | | | |
|---|---|---|---|---|
| . . . | . . . | . . . | . . . | . . . |
| $+x_2$ | $k_{02}$ | $k_{12}$ | $k_{22}$ | . . . |
| $+x_1$ | $k_{01}$ | $k_{11}$ | $k_{21}$ | . . . |
| $x_0$ | Initial Parameters | | | |
| $-x_1$ | $-a_{01}$ | $-a_{11}$ | $-a_{21}$ | . . . |
| $-x_2$ | $-a_{02}$ | $-a_{12}$ | $-a_{22}$ | . . . |
| . . . | . . . | . . . | . . . | . . . |

Generally, there may be more or less parameter sets than those illustrated in Table 1, depending on the particular non-linear function implemented. For example, Equation (4) above requires computation of only coefficients for the $1^{st}$, $3^{rd}$ and $5^{th}$ order terms. In some embodiments, the data of Table 1 are stored in the memory of the receiver as a look-up table. The look-up table may be subsequently referenced by the receiver processor to determine an updated set of parameters based on a detected change in rest position. The updated parameters may then be applied to the non-linear function for use in pre-distorting the input signal. In some embodiments, the algorithm implementing the look-up table includes interpolation functionality that computes sets of parameters for reed rest positions that are between the rest positions for which the tabulated data was determined. The algorithm implementing the look-up table may also include extrapolation functionality that computes sets of parameters for reed rest positions that are beyond the positions for which the tabulated data was determined. The interpolation and extrapolation functions may be based on linear or non-linear approximations relative to the tabulated data points.

In other embodiments, the alternative sets of parameters of Table 1 may be used to formulate one or more mathematical functions that model the relationship between reed rest positions and corresponding sets of function parameters. The functional model could be a single function or a set of piece-wise linear or non-linear functions. For example, a separate function or set of functions could be used to model each parameter as a function of reed rest position. Such functions may be generated using known curve fitting techniques such as regression analysis or other function approximation methodologies. Like the look-up tables, these functional models may be stored on the receiver for use in updating the set of parameters upon detecting a change in reed rest position. The use of interpolation or extrapolation algorithms may not be required where mathematical functions are used to model the relationship between reed rest position and sensed information indicative of the change in reed rest position. The look-up table or the function relates information from the receiver representative of the change in reed rest position (e.g., impedance, strain, pressure . . . ) to corresponding set of parameters.

A change in reed rest position, also referred to as change in receiver balance, may be detected directly or indirectly. In one implementation, a reed rest position change is detected by monitoring a change in receiver impedance. Receiver impedance may be detected directly by measurement at the receiver coil.

Alternatively, a change in reed rest position may be monitored using a reed strain gauge. FIG. 10 illustrates a strain gauge 1032 disposed on a portion of the reed 1004 for this purpose. The change in reed rest position may also be monitored by measuring changes in air pressure of the receiver using one or more pressure sensors, for example the sensor 1026 located in the front volume, the sensor 1028 in the back volume, or by using pressure sensors located in both the front and back volumes. Thus Table 1 above or any corresponding function(s) may relate the alternative sets of coefficients or other function parameters to anyone of these detectable conditions.

Another circumstance that may affect receiver output is a change in frequency response of the receiver. Such a change may be attributable to acoustic leakage in the hearing instrument (e.g., hearing aid, headphones, etc.), ear wax accumulation in a hearing-aid acoustic passage, among other changing characteristics of the receiver or system that occur in use. As suggested above, an optimized set of initial parameters are calculated for an initial frequency response $f_0$ of the receiver. Alternative sets of parameters may also be determined for different frequency responses of the receiver. For example the frequency response could be changed by incrementally changing acoustic leakage of the test load and new sets of parameters may be calculated for each incremental change. Alternative sets of parameters may also be determined for incremental changes in acoustic blockage that correspond to wax accumulation in a hearing-aid. The frequency response of the receiver may also be changed based on other changing characteristics of the receiver as well and alternative sets of parameters may be determined accordingly. Like the example above, the alternative sets of parameters are iteratively optimized for each incremental change to an actual receiver. Alternatively, the alternative sets of parameters are optimized using a model of the receiver and the load. The alternative set of parameters optimized for different frequency responses of the receiver may be tabulated as follows:

TABLE 2

| Frequency Response | Filter Parameters | | | |
|---|---|---|---|---|
| $f_0$ | Initial Parameters | | | . . . |
| $f_1$ | $b_{11}$, $a_{11}$ | $b_{12}$, $a_{12}$ | $b_{13}$, $a_{13}$ | . . . |
| $f_2$ | $b_{21}$, $ab_{11}$ | $b_{22}$, $a_{22}$ | $b_{23}$, $a_{23}$ | . . . |
| . . . | . . . | . . . | . . . | . . . |

Figure 11A:
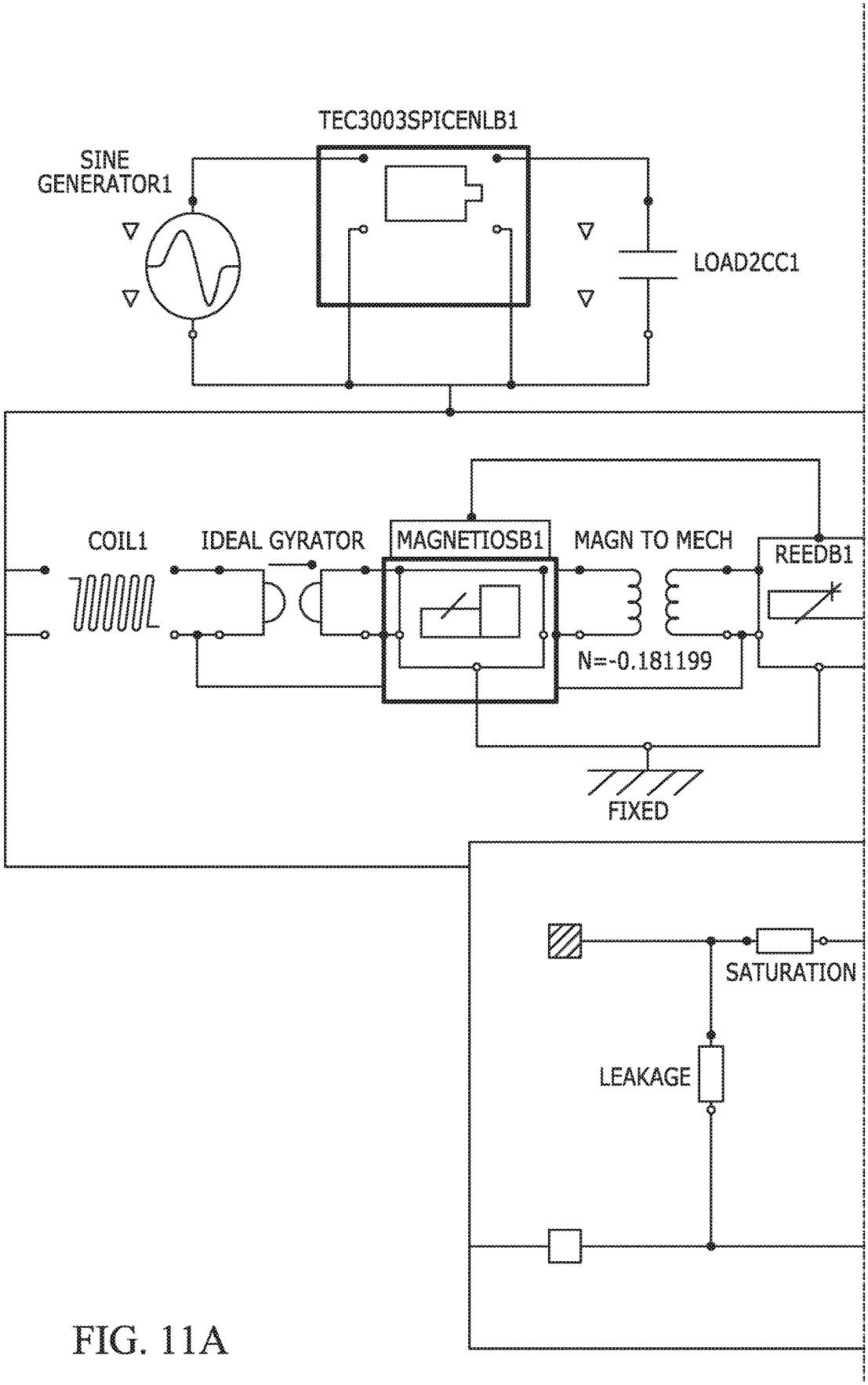
FIGS. 11A-B are graphical representations of a computable model of an armature-based receiver.
Figure 11B:
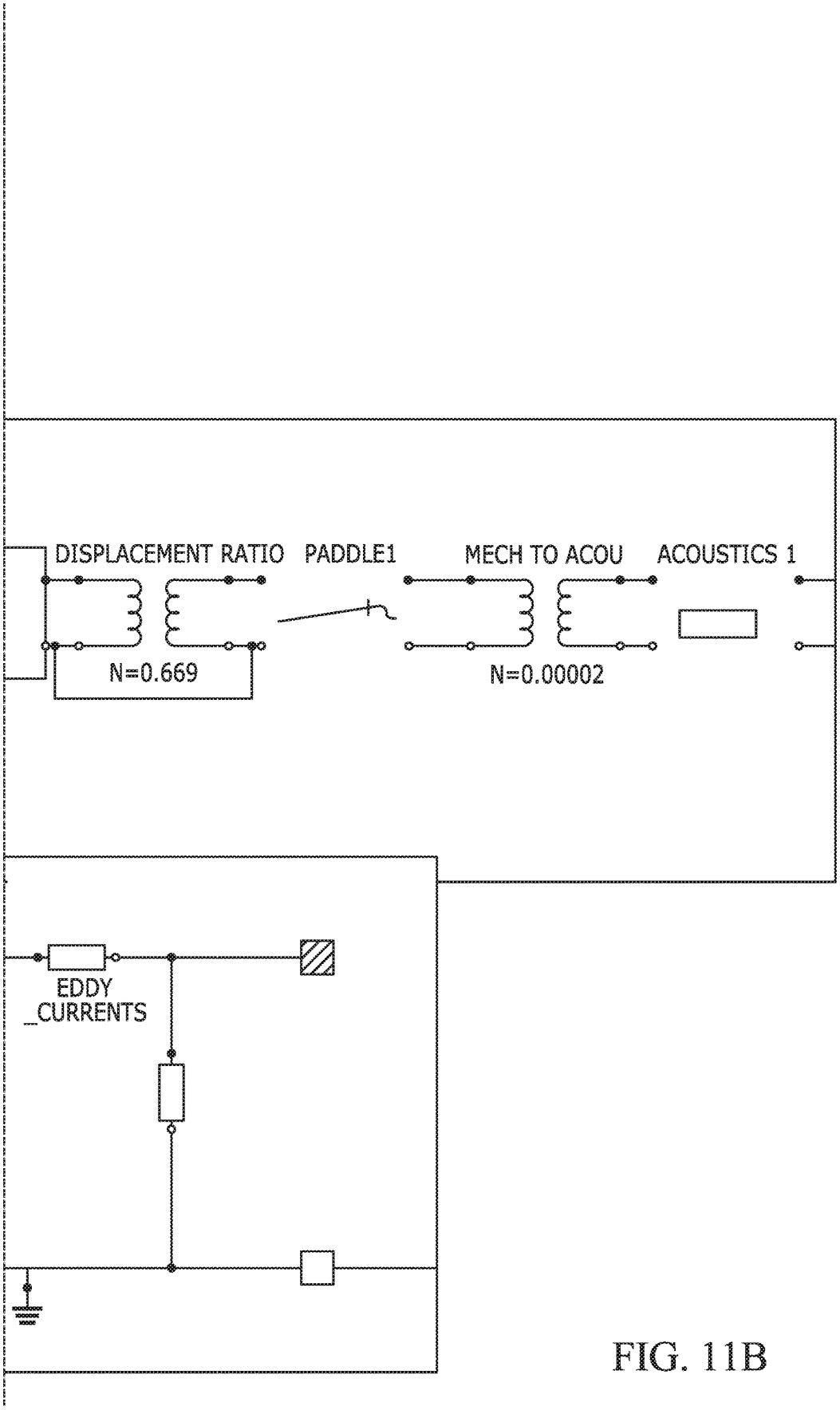
Figure 12:
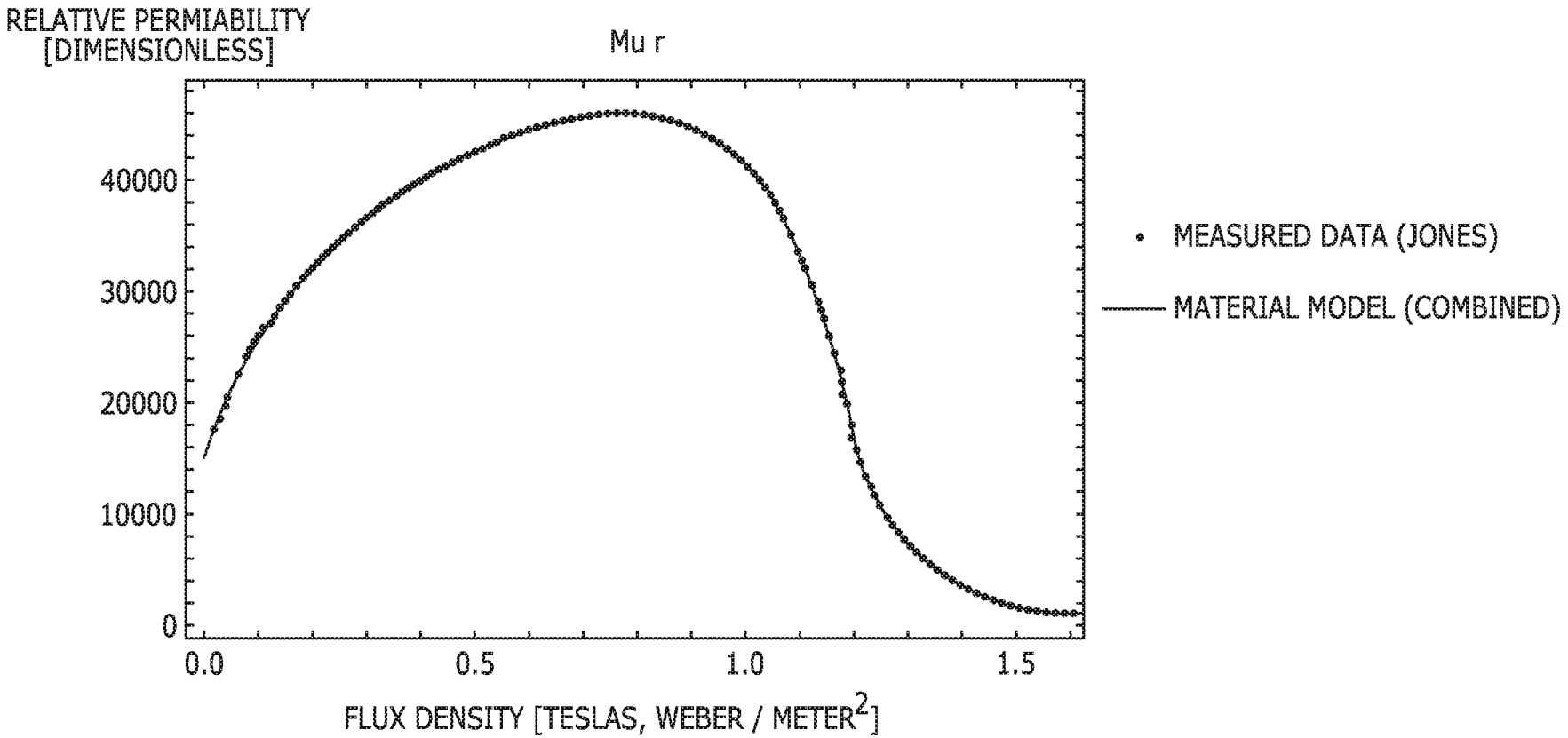
FIG. 12 is a plot of relative permeability versus flux density.

Generally, there may be more or less parameter sets than illustrated in Table 2 depending on the function implemented (e.g., whether the function is odd or even). In some embodiments, the data in Table 2 are stored in the memory of the receiver as a look-up table. The look-up table may be subsequently used by the receiver to determine updated parameters based on detected changes in various receiver characteristics (including load characteristics) indicative of a change in frequency response. In some embodiments, the algorithm implementing the look-up table includes interpolation or extrapolation functionality that computes sets of parameters for changes in frequency response between or beyond the positions for which the tabulated data was determined, as discussed above. In other embodiments, the parameters in Table 2 are used to formulate one or more mathematical functions that model the relationship between frequency response and information indicative of the change in receiver characteristic. For example, a separate function could be used to model each parameter as a function of frequency response. Such functional models may be generated using known curve fitting techniques like as regression analysis or other function approximation methodologies as discussed above. Like the look-up tables, these functions may be stored on the receiver for use in updating the parameters upon detecting a condition indicated of a change in frequency response. The change in receiver frequency response may be detected by monitoring changes in resonance peaks and other characteristics of the frequency response. In one embodiment, the frequency response of the receiver is monitored using a Fast Fourier transform (FFT) or Discrete Fourier Transform (DFT) applied to an electrical signal representative of the receiver output. The electrical signal may be generated using a microphone disposed at the output of the receiver. FIG. 10 illustrates schematically an acoustic sensor 1030 located just outside or inside the receiver output port for this purpose. Another approach is to apply a test signal at a resonant frequency of the receiver and measure a magnitude of the electrical signal representative of the output at one or more resonance frequencies. The look-up table, e.g., Table 2 above, or a functional model may be used to relate the sets of parameters to FFT or DFT outputs or other sensed conditions indicative of the change in frequency response. In some embodiments, it may be desirable to control the amplifier output for changes in a characteristic of the receiver. For voltage driven receivers, it may be desirable to adjust the output (e.g., magnitude or phase) of a voltage amplifier to compensate for a changing impedance of the receiver. For example, the magnitude or phase of the voltage amplifier output may be adjusted as the receiver impedance changes to provide a more constant current level or to control the phase of the amplifier output signals. The receiver impedance can be measured directly at the receiver coil and sensed changes may be used to control the voltage of the amplifier. For current amplifier driven receivers, it may be desirable to adjust the output (e.g., amplitude or phase) to compensate for changing receiver characteristics. In FIG. 9, the processor 930 adjusts or compensates the output of the amplifier 926 using conditioning circuit 932 based on a changing receiver characteristic indicated by feedback 936. In battery powered devices, the battery provides power to the conditioning circuit. The conditioning circuit 932 may also include a voltage regulator, charge pump, and other power supply conditioning circuits. In one embodiment, the computable non-linear function or parameters of the function are selected by the electrical circuits associated with the receiver system rather than by a test system like the system 800 of FIG. 8. According to this aspect of the disclosure, the functionality of the input signal generator 806, distortion calculator 816 and the inverse model generator 802 of FIG. 8 are implemented by a processor associated with the receiver. For example, this functionality could be implemented by one or more processors of integrated circuit 900 of FIG. 9. A sensor on the output of the receiver can provide output signal distortion feedback from which the initial computable non-linear function may be updated. Thus configured, the processor associated with the receiver can generate and optimize the non-linear function for an initial characteristic of the receiver or for subsequent characteristics of the receiver by applying a pre-distorted test signal to the input of the receiver and implementing one of the iterative processes discussed herein until the desired level of output distortion is attained. The non-linear function may be optimized from time to time to accommodate or compensate for changes in the initial characteristic of the receiver. Implementing non-linear function optimization on the processor associated with the receiver may eliminate the need to perform some or all of the optimization on the system 800 discussed above in connection with FIG. 8. FIGS. 11A-B are a schematic representation of an equivalent circuit model of a receiver that may be implemented numerically. The model is based on electrical analogies (tec30033spiceNLB1) having a signal source (sineGenerator1) and a load (load2CC1). This technique produces a linear model of a receiver. The model typically includes a current variable and a voltage variable. Such a model can be implemented by several commercial programs, like SPICE. The numerical model is a transformation of receiver components into the electrical domain wherein masses are represented by inductors, stiffness by capacitors, losses by resistors, acoustical cavities by capacitors, acoustical lengths by inductors, and viscous damping effects by resistors. In FIGS. 11A-B, pure magnetic reluctances (e.g., saturation, gap, and leakage elements) are transformed, or modeled, as capacitors. In the magnetic domain, reed saturation, negative stiffness, leakage and air gaps are modeled along with losses due to eddy currents. According to this model, the parameter describing the magnitude of the capacitor (representing armature saturation) is changed according to the flux density and proportional to the permeability of the reed. Total flux is the sum of the flux generated by the coil and the flux from magnets diverted into the armature as a function of position minus the flux lost due to leakage. The total flux divided by the cross-sectional area of the reed is the flux density that can be converted to a permeability through the function shown in FIG. 12. The model of the receiver will perform substantially similarly to a real device. The model can be used to determine parameters using the iterative approach described above. Second, since the equations are now described in the model, a detailed inverse model can be created. The inverse model could be directly applied to the input signal to produce the pre-distorted output.

Figure 14:
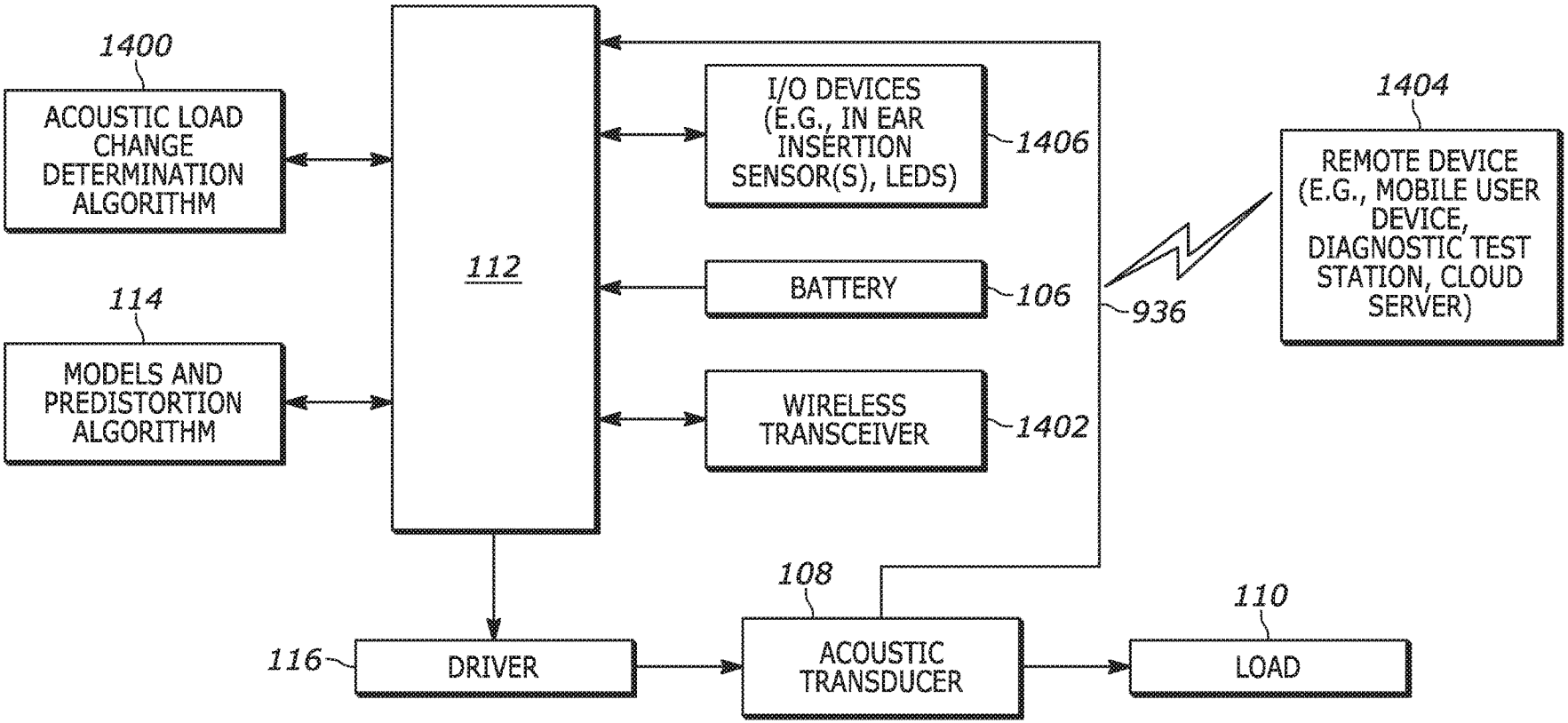
FIG. 14 is a block diagram illustrating an example of a system employing an acoustic receiver with acoustic load change determination.

Referring to FIGS. 9, 10, and 14, in this example, the integrated circuit includes a processor 930 that executes the acoustic load change determination algorithm 1400 that, as noted above, uses receiver feedback information 936 such as an electrical output signal that is proportional to a sound pressure of an acoustic signal from a front volume, and/or back volume, and/or acoustic output passage of the acoustic receiver. The acoustic signal is converted to an electrical output signal by the feedback interfacing conditioning block 928 or may be done by a microphone positioned to detect the acoustic output in the front volume or back volume or acoustic passage. In one example the electrical output signal is proportional to the sound pressure of the acoustic signal. The acoustic load change determination algorithm causes the processor to determine whether there is a change in the acoustic signal indicative of a change in an acoustic load coupled to the acoustic receiver by comparing the electrical signal to reference information. The change in the acoustic signal is indicative of, for example, foreign particle blockage or acoustic leakage, or other condition. In one example, the reference information includes data stored in memory 922. In another example the reference information is generated by the processor by executing one or more functions.

FIG. 14 also illustrates that the integrated circuit 900 may include or be coupled to a wireless transceiver 1402 to allow remote communication of notifications such as resulting diagnostic data or other information to a remote device 1404 which may be, for example, a mobile user device such as a smartphone, wearable, or other mobile device. In addition or alternatively, the remote device 1404 may be a cloud based server, or a diagnostic test system which may be configured to diagnose the acoustic receiver. As shown, the hearing device may also include input/output devices 1406 such as in-ear insertion sensors which may be capacitive sensors that detect that the hearing aid or hearing device has been inserted into an ear or removed from the ear. The diagnostic operation to determine whether an acoustic load has changed may be automatically activated upon removal of from the ear. Also, selection of the appropriate expected transfer function may depend on whether or not the device is coupled. The acoustic device may include a visual output devices such as LEDs so that a user or technician can be visually notified of sensed conditions. In other embodiments, the electrical circuit may provide one or more audible tones or a message indicating a need for service based on the diagnosis. Diagnostic data may also be stored in memory of the electrical circuit for later interrogation by a service technician. In other embodiments, other suitable input/output devices may be used to indicate the status of the acoustic device or permit sharing of data on the device. The processor 112 may also serve as the processor that serves as the acoustic load change determination circuitry, similar to the processor 930 in FIG. 9.

Figure 15:
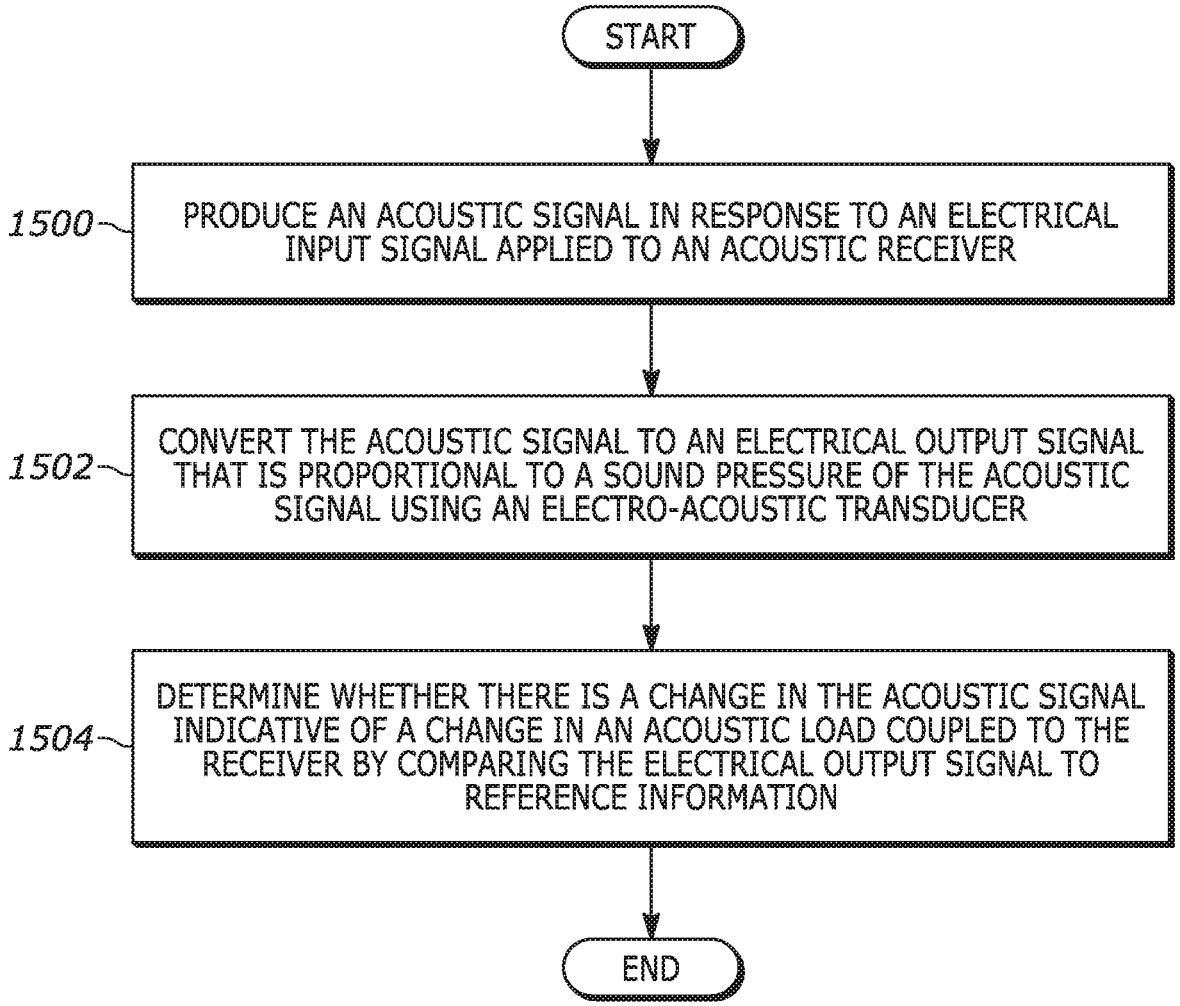
FIG. 15 is a flow chart illustrating one example of a method in an acoustic receiver.

FIG. 15 illustrates one example of an algorithmic process or method for diagnosing a change in an acoustic load of a receiver, such as the type shown in FIG. 10. The method may be carried out while the acoustic receiver is in use by a user or may be carried out when the acoustic receiver is in a test system. In FIG. 15, in block 1500, the method includes producing an acoustic signal in response to an electrical input signal applied to an acoustic receiver. This is done, in one example by the processor providing a drive signal as the electrical input signal for the acoustic receiver, examples of which are discussed herein. As shown on block 1502, the method includes converting the acoustic signal to an electrical output signal, such as receiver feedback information 936, that is proportional to a sound pressure of the acoustic signal using an electro-acoustic transducer. This is done in one example by one or more sensors 1026, 1028, and 1030 shown in FIG. 10. In FIG. 15, in block 1504, the method includes determining, such as by processor 930 in FIG. 9 or processor 112 in FIG. 14, or any other suitable electrical circuitry, whether there is a change in the acoustic signal indicative of a change in an acoustic load coupled to the receiver. This may be done, for example, by comparing the electrical output signal to reference information stored in memory 922 or generated by the processor 930 using a function. Since the processor provides the electrical input signal to the receiver and since reference information is available indicating what to expect as output from the expected or reference transfer function, the processor can determine any change in the acoustic load. The expected transfer function (also referred to as sensitivity) of the receiver is substantially linear over a known range of operation of the receiver (e.g., relatively low to intermediate amplitude electrical input signals) These ranges are good input signals to use both to generate the reference transfer function and to measure during normal operation of the device to determine a change in acoustic signal.

Figure 16:
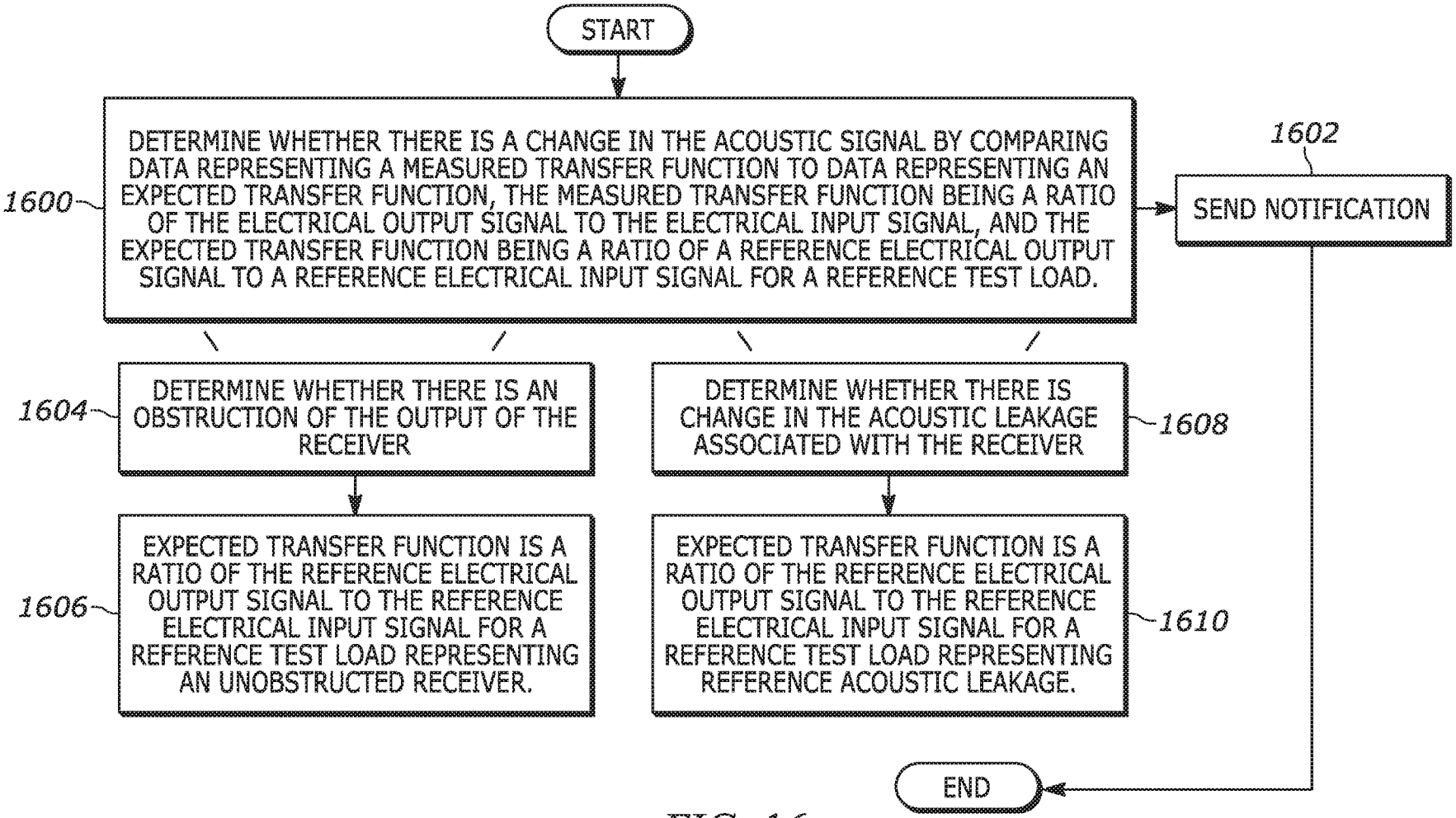
FIG. 16 illustrates an example of a method in an acoustic receiver.

FIG. 16 illustrates an example method for an acoustic device including determining whether there is a change in the acoustic signal by comparing data representing a measured transfer function to data representing an expected transfer metric, as shown in block 1600. Data representing the expected transfer function is stored in memory or may be generated by the processor from a programmed function or set of functions that model the expected transfer function. As described above with respect to the acoustic load, the data representing the expected transfer function may be obtained using reference load information. At block 1602, in some embodiments, the method includes providing a notification when there is a change in the acoustic signal indicative of a change in the acoustic load. For example, the processor generates information for cloud server, at the receiver, at the acoustic device, or may be stored in the device for later interrogation. Notifications can include any suitable data. The determining operation may also be carried out by a processor or other circuitry in any suitable device as discussed herein.

Either or both of the obstruction diagnostic process in blocks 1604 and 1606 and the coupling integrity process in blocks 1608 and 1610 may be performed. As shown by blocks 1604 and 1606, determining whether there is a change in the acoustic signal includes determining whether there is an obstruction of the output of the receiver, wherein the expected transfer function is a ratio of the reference electrical output signal to the reference electrical input signal for a reference acoustic load representing an unobstructed receiver. Reference loads representative of various levels of full obstruction may also be used. As shown in blocks 1608 and 1610 determining whether there is a change in the acoustic signal includes determining whether there is a change in acoustic leakage, wherein the expected transfer function is the ratio of the reference electrical output signal to the reference electrical input signal for a reference acoustic load for a reference acoustic leakage or seal.

The method may also include detecting front volume sound pressure wherein the receiver includes an armature linked to a diaphragm that separates a housing of the receiver into a front volume and a back volume, by converting the acoustic signal to the electrical output signal using an electro-acoustic transducer located to sense sound pressure in the front volume of the receiver. The method may include detecting back volume sound pressure wherein the receiver includes an armature linked to a diaphragm that separates a housing of the receiver into a front volume and a back volume, by converting the acoustic signal to the electrical output signal using an electro-acoustic transducer located to sense sound pressure in the back volume of the acoustic receiver. The method may include detecting sound pressure in an acoustic port wherein the receiver includes an armature linked to a diaphragm that separates a housing of the receiver into a front volume and a back volume, the receiver output includes an acoustic port acoustically coupled to the front volume, by converting the acoustic signal to the electrical output signal using an electro-acoustic transducer located to sense sound pressure in the acoustic port.

Figure 17:
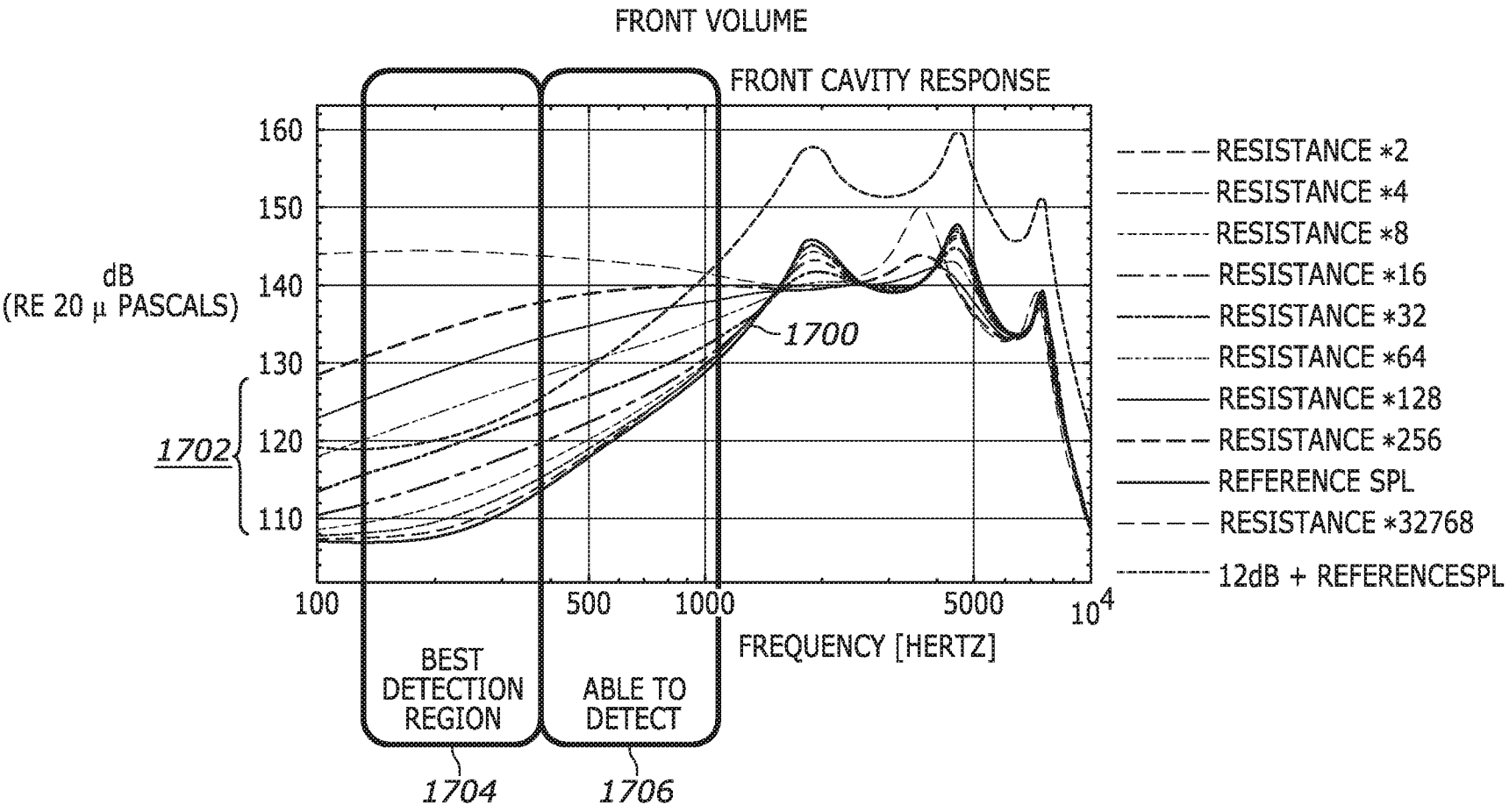
FIG. 17 is a graph illustrating example reference information in the form of front cavity frequency response information and curves indicative of a change in acoustic load from the perspective of a front cavity in an acoustic receiver.

The method may include detecting front volume sound pressure below a resonance frequency wherein the receiver includes an armature linked to a diaphragm that separates a housing of the receiver into a front volume and a back volume, by converting the acoustic signal to the electrical output signal using an electro-mechanical transducer located in a front volume of the receiver. The resonance frequency may be a primary mechanical resonance frequency or an acoustical resonance frequency as discussed herein. FIG. 17 shows the reference information corresponding to a maximum sound pressure of the receiver in the 12 dB+Reference SPL plot that the receiver can be produced in the front volume in the absence of obstruction of the output of the receiver. Any sound pressure detected in the front volume greater than the maximum sound pressure level indicates acoustic blockage. Comparisons at frequencies below the resonance frequency of the receiver may be most efficacious but the comparison of the output signal to the reference information may be performed at any frequency. FIG. 10 shows microphone 1026 in the front volume suitable for detecting the acoustic output.

In FIG. 10, the acoustic receiver 1000 is an armature-based acoustic receiver including at least one electro-acoustic transducer positioned in at least one of the front volume, the back volume and the output of the receiver. The electrical circuit is operative to determine whether there is a change in an acoustic signal of the receiver based on sound pressure sensed by the at least one electro-acoustic transducer, wherein the change in the acoustic signal is indicative of a change in an acoustic load coupled to the receiver. The electrical circuit may be part of the receiver or some other part of the acoustic device with which the receiver is integrated.

As noted above, only one pressure sensor may be employed, however multiple pressure sensors may also be employed as desired. For example, a transducer in the front volume or downstream of the front volume, may be used for seal detection. A transducer in the back volume may be better to capture changes around the primary mechanical resonance frequencies. A transducer in the back volume is also more applicable to adapting predistortion. The processor 930 determines whether there is a change in the acoustic load by comparing the electrical signal from the respective sensor to reference information stored in memory. The reference information as noted above may be any suitable reference information including but not limited to data representing one or more points along a frequency response curve, an amplitude value at one or more frequencies, a frequency of a peak or valley, Q (quality factor), change in frequency from an expected frequency, or any other suitable information (see also FIGS. 17-19). The integrated circuit 900 in one example need not include the pre-distortion operation.

Figure 27:
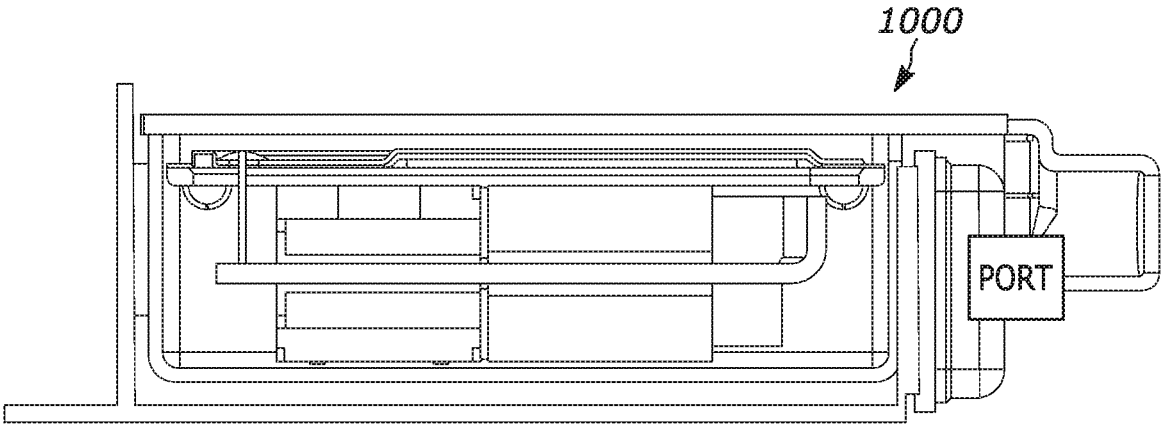
FIG. 27 illustrates an example of a sensor location in an acoustic receiver.

As noted above, when it is determined that there is a change in acoustic load in an output of the acoustic receiver, in one example the processor 930 issues a notification of the change in acoustic load to an appropriate device, such as a visual indicator on the hearing device itself, such as an LED, a message sent to the user's smartphone so that an application on the smart phone that is configured to respond to the notification, presents one or more user interfaces (see, for example, FIG. 27), may send a notification to a test system to notify the test operator that an acoustic load changes has occurred, or to any other suitable device such as a web server that may use the information to notify the user or an audiologist. As noted above, the circuitry in one example determines whether there is a change in acoustic load by determining whether there is a change in frequency response of the acoustic receiver by, for example, comparing a measured sound pressure of an acoustic signal (such as, with respect to the front volume, back volume, and/or output port) as compared to a reference frequency response. In one example, the change in acoustic load is determined by using reference information corresponding to an expected sound pressure level (SPL) at a frequency or range of frequencies of an acoustic signal at the output of the receiver. This may be done, for example, by using the sensor 1030. However, this may also be done by using sensor 1026 and/or sensor 1028 since a change in condition in either the front or back cavity can result in an undesirable audible signal at the output port of the receiver.

The method in FIGS. 15 and 16 can be carried out at any suitable time and may depend on whether the method is carried out by the hearing device that uses the acoustic receiver or if the method is carried out when the hearing device is in a test unit as opposed to a user's ear in the case of a hearing aid, or being used by the user.

Determining whether there is a change in acoustic load of the acoustic receiver will be described with reference to FIGS. 17-19. As noted above, the memory 922 may store reference information (See also FIG. 6). In this example data representing an expected transfer function is shown as expected SPL information shown by points along reference SPL curve 1700. As also noted, reference information includes a function that may be stored instead of the actual data from which the data can be derived. As used herein, the function or the data itself serves as the reference information. The function may be used to determine points along a frequency response curve, for example, an expected transfer function generated using a reference load representing no obstruction or acoustic leakage. An entire transfer function need not be stored. A single point on the curve at a particular frequency could be used or multiple points may be stored. Also the entire measured transfer function could be calculated and proper points on that transfer function could be compared to the stored data point. In one example, the initial frequency or reference frequency response is that of the receiver in the absence of an obstruction such as a wax induced obstruction or acoustic leakage and is shown as "reference SPL" information 1700. The information representing the other curves 1702 is transfer function information indicating the frequency response in the front cavity based on different resistance test loads at the output port of the acoustic receiver. In one example, the reference information 1700 is determined for a given voltage or current setting of the acoustic receiver as part of the manufacturing process. However, any suitable reference information may be used. The converted acoustic signal is compared to the information to determine whether there is a change in acoustic load.

Receiver output pressure is detected via the front cavity microphone 1026 which may have certain advantages in that the front cavity microphone 1026 is protected from the direct wax buildup that may occur in the ear canal of a user, for example. As seen in FIG. 17, changes in acoustic load are shown by the different resistance curves 1702 and sound pressure increases above the reference SPL 1700 (reference information) are detected by the front cavity microphone 1026. A "best detection region" 1704 is identified although all other regions may also be used.

In one implementation, the circuitry such as processor 930 provides a inaudible test signal as the electrical signal to the acoustic receiver in a front volume of the acoustic receiver and the pressure microphone 1026 is operative to monitor pressure caused by the inaudible test signal. This can allow for in-ear testing so that a user is unaware of the testing of obstructions during, for example, normal operation of the device. As noted, the microphone 1026 is located to sense sound pressure in the front volume of the receiver. In another example, the resulting signal from the microphone may be at a frequency below a mechanical resonance of the acoustic receiver. The reference information in this example corresponds to an expected sound pressure of the acoustic signal at the frequency below the mechanical resonance of the receiver in the absence of obstruction at the output of the acoustic receiver. As such, the front volume microphone 1026 can detect a change in acoustic load that is undesirable simply by measuring a high enough pressure level in the front cavity. Also, given the higher sound pressure levels, the microphone 1026 have a lower sensitivity compared to the microphones 1028 and 1030.

Figure 18:
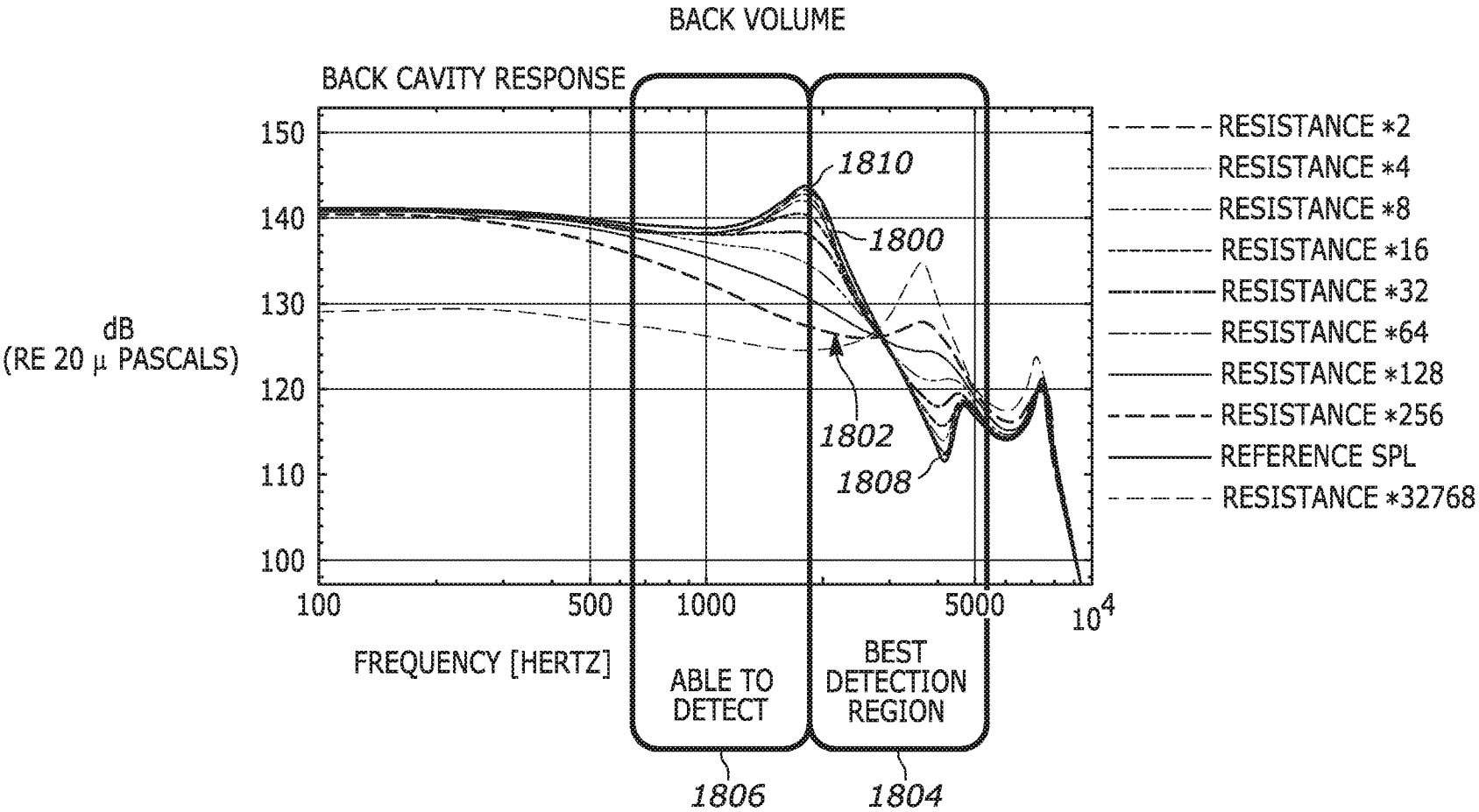
FIG. 18 is a graph illustrating example reference information in the form of back cavity frequency response information and curves indicative of a change in acoustic load from the perspective of a back cavity in an acoustic receiver.

FIG. 18 illustrates similar information as that shown in FIG. 17, except for the back volume or back cavity. Load change detection can be determined by comparing the expected transfer function to the measured transfer function as described above, without having to store and process substantial amounts of data described below. In this back volume example, a "best detection region" is shown at 1804 but the comparisons may be made in all regions where there is measurable distinction between output levels.

As can be seen, the "reference SPL" information 1800 may be used as the reference information against which sensed sound pressure as measured by the sensor 1028 is compared to determine whether an acoustic load at the output of the acoustic receiver exists and, if desired, extent. Storing data indicative of the other resistance curves 1802 allows the system to determine the extent of the obstruction or seal degradation. For all sensors, any of the resistance curves may be used as the reference information if desired. It should also be recognized that any other suitable reference information may be used as desired. As shown, the determination as to whether an acoustic load exists based on back volume sound pressure detection may be a function of whether the detected sound pressure is higher or lower than that at a reference frequency or set of frequencies of the reference SPL 1800. This assumes that the input signal to the receiver at the time that the sensors took their measurements is the same as that used to generate the curves. This could be achieved by programming the diagnostic electrical input signal described above to have the same parameters (voltage, frequency and phase) as the electrical input signal used to generate the data corresponding to the acoustic response versus frequency for the various resistance levels. If the input signal is different at the time of measurement, then transfer function curves corresponding to that input signal level can be used or the curves from a different input signal level could be used to extrapolate the degree of resistance. This latter approach would require storage in memory of the acoustic device multiple sets of acoustic response versus frequency plots for multiple electrical input signals over the range of possible input signals. Hence knowledge of the input signal to the receiver is used to determine which transfer function to employ or to extrapolate a transfer function corresponding to a different input signal.

In FIG. 18, as can be seen, there is good detection capability at the resonant frequencies 1808 and 1810. In addition, there is low ear wax obstruction risk for the microphone 1028 since it is located furthest from the output port 1024 and is behind the front cavity and behind the panel 1014 (see FIG. 10). The sound pressure levels are also relatively high in the back cavity, and as such a lower sensitivity microphone 1028 may be desired.

Figure 19:
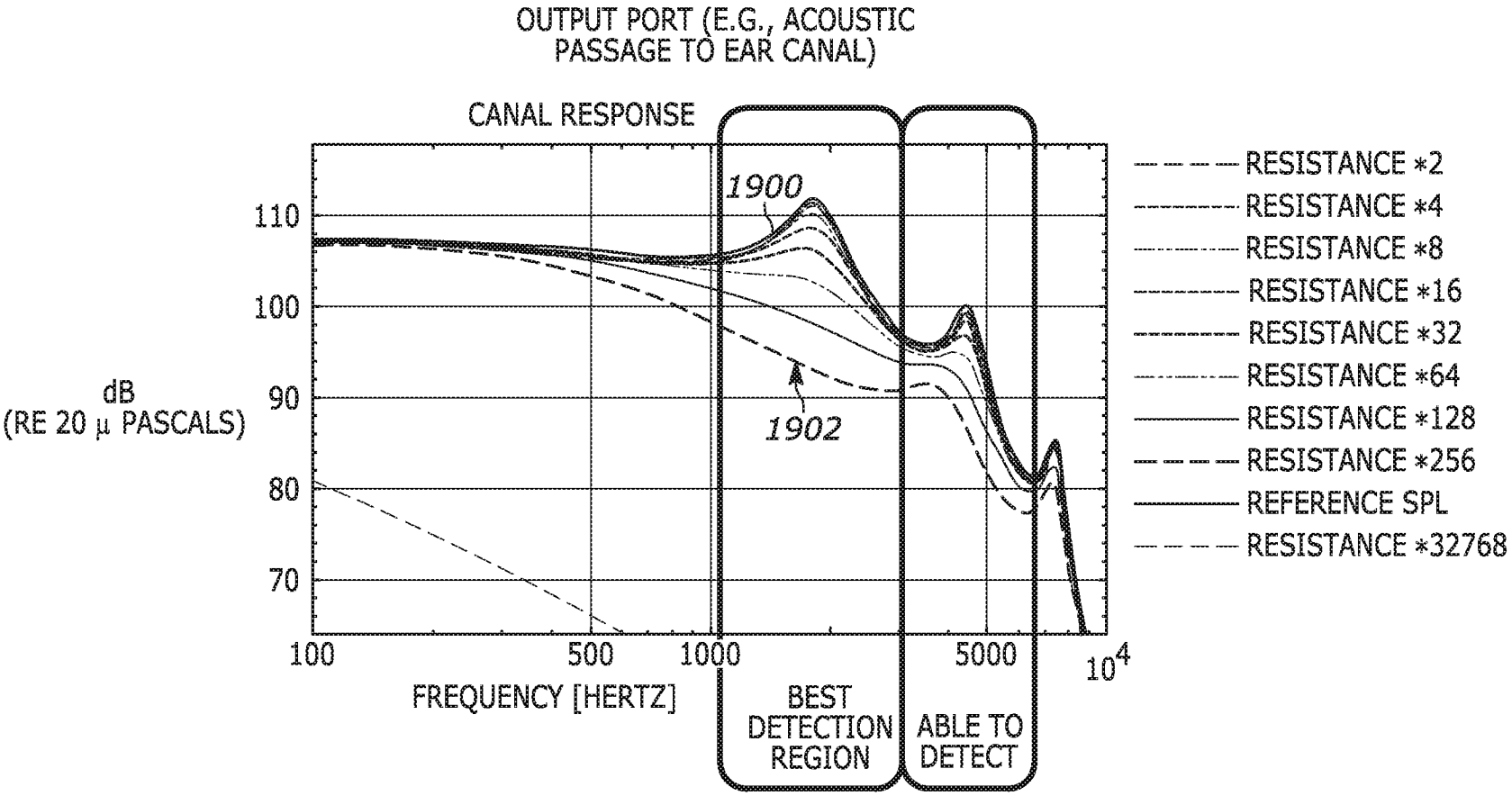
FIG. 19 is a graph illustrating example reference information in the form of output port frequency response information and curves indicative of a change in acoustic load from the perspective of an output port in an acoustic receiver.

FIG. 19 similarly illustrates examples of reference information 1900 (reference SPL) and 1902 (data representing values of resistance curves) that may be used by the described system to determine whether there is a change in acoustic load associated with the acoustic receiver. These curves illustrate information associated with the output port of the acoustic receiver. Complete blockage detection can be accomplished with just a pressure measurement similar to that of the front cavity. Also, different degrees of blockage can be detected as with the other sensors using data associated with the resistance curves 1902 for given input signal to the receiver. As noted above, partial blockage can be detected using any of the sensors alone.

Figure 28:
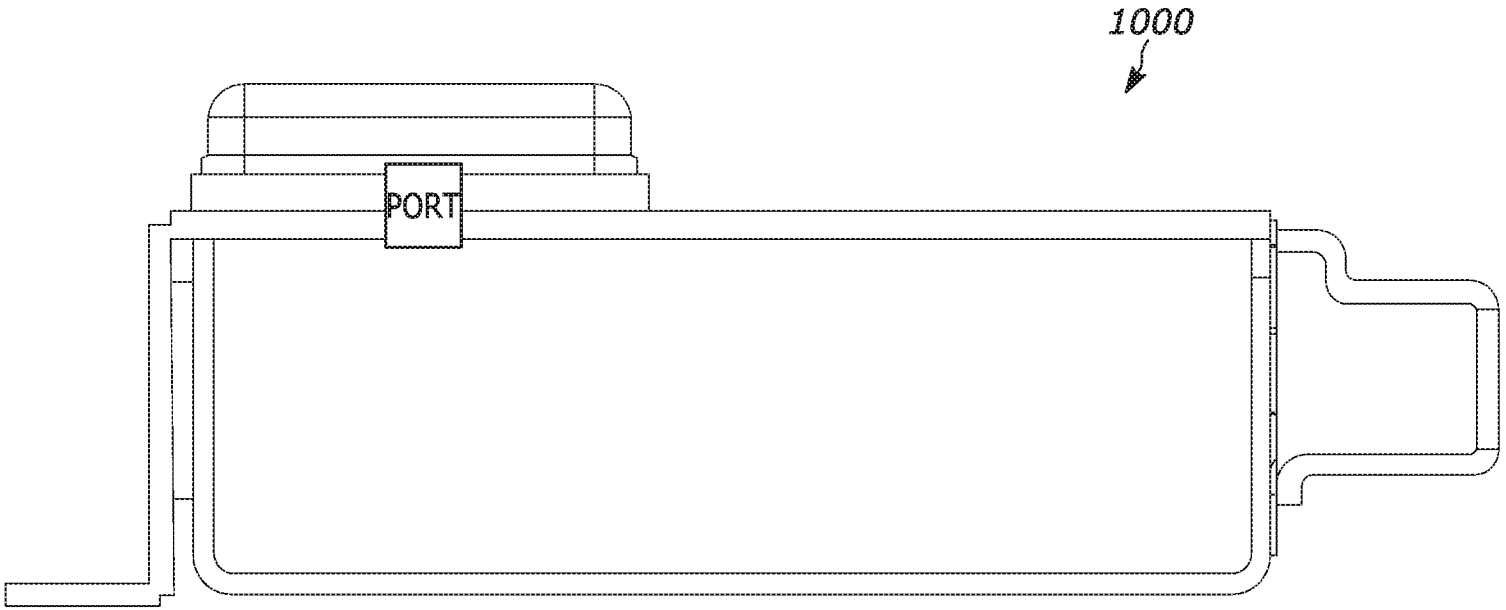
FIG. 28 illustrates an example of a microphone location in an acoustic receiver wherein the microphone or circuit element (circuit board, flex circuit, substrate etc.) attached to the microphone constitutes a portion of the receiver housing and defines a portion of the front volume.

Referring back to FIG. 10 and FIGS. 22-27 differing locations of the various sensors are shown using dashed lines in FIG. 10. It will be recognized that an actual sensor assembly may have a housing portion mounted to an outside surface of the receiver housing so that the sensors are not physically in the front and rear volumes or in the output port but a located to sense pressure in the respective locations as further shown by FIGS. 22-27. A port through a receiver housing wall may be used that allows sound pressure to be measured by the sensor. Any other suitable configuration may also be employed. As shown, sensor 1026 may also be suitably positioned to measure pressure in the front volume ahead of linkage 1016. Sensor 1028 may be located along a rear sidewall in the back volume, along a forward (toward output port 1024) sidewall behind a tube that defines at least a portion of the output port or at any suitable location. The sensor 1030 may be positioned to measure sound pressure inside a tube of the output port. In this example the sensor 1030 is shown to be placed to measure pressure behind a wax guard 1025 to minimize wax build up on the sensor. As also shown in some of the FIGS. 22-28, the electro-acoustic transducer is located to sense pressure in the front volume of the receiver and the electro-acoustic transducer is disposed on a substrate, such as a flexible printed circuit board or other substrate that forms (defines) at least part of the front volume of the receiver. Similarly, in other examples, the electro-acoustic transducer is located to sense pressure in the back volume of the receiver and the electro-acoustic transducer is disposed on a substrate that forms part of the back volume of the receiver. Also in other examples, the electro-acoustic transducer is located to sense pressure in the output of the receiver and the electro-acoustic transducer is disposed on a substrate that forms part of the output of the receiver. FIG. 28 illustrates an example of a sensor location in an acoustic receiver wherein the sensor constitutes a portion of the receiver housing and defines a portion of the front volume. However, any suitable locations may be used.

The determination of a change in acoustic load, in one example, is not accompanied by any correction using a pre-distortion signal. However, it will be recognized that applying equalization correction may be sued to allow the user to have better performance with partial blockage, for example.

Figure 20:
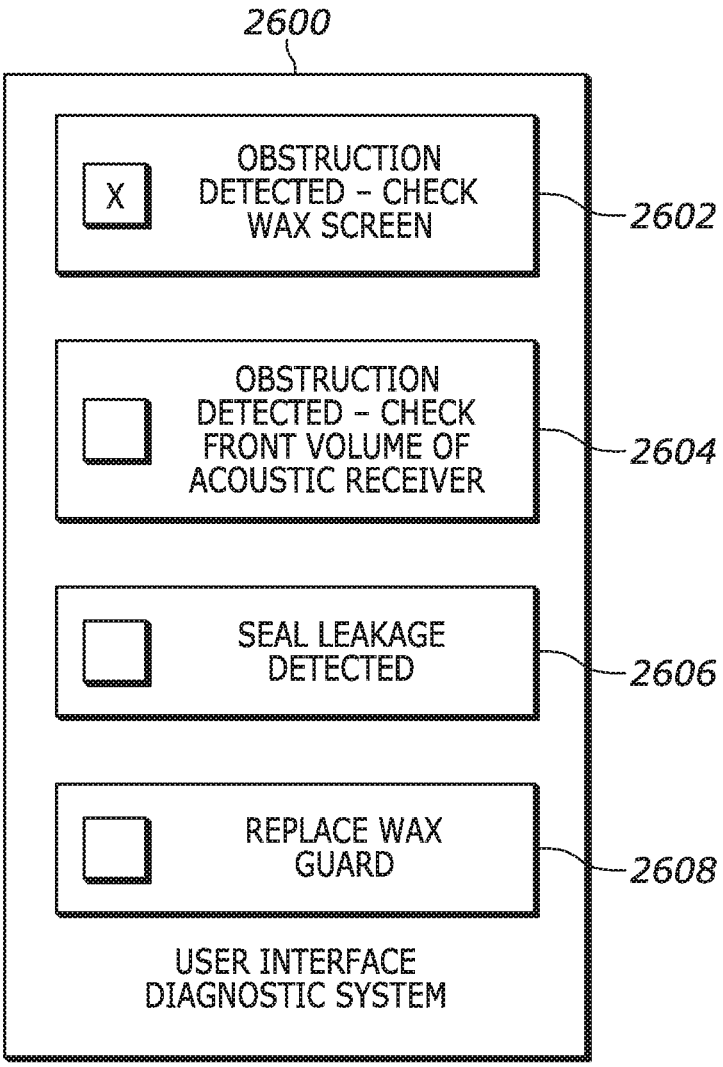
FIG. 20 illustrates an example of a user interface.

FIG. 20 illustrates an example of a user interface that may be presented on the display of the external test system that is testing the hearing device. The test system includes a display, a processor, memory, and associated interface circuits to allow communication with the hearing device and, if desired, other devices and networks. As shown, the user interface 2600 presents data representing whether a change in acoustic load has been detected, shown generally as information 2602, 2064, 2606 and 2608. For example, if the degree of a change in acoustic load is indicative of an ear wax obstruction that should be removed, such information may be presented to the test operator so that the acoustic receiver may be cleaned or repaired. More specific information as to the location of the obstruction may be provided as well, such as shown by information 2604 indicating that an obstruction was detected and that the front volume of the acoustic receiver has been impacted. This may result in a different type of maintenance operation being required of the hearing device. As shown by information 2606, a type of change in acoustic load may be identified. In this case, seal leakage may be identified compared to an obstruction caused, for example, by ear wax. As shown by information 2608, a notification that a wax guard on the acoustic receiver should be changed can be issued. Other information may also be provided in addition to or instead of the information indicated herein. For example, the level or extent of obstruction may be identified indicating, for example, that a "low or high level of obstruction" depending upon the amount of determined change in acoustic load. For example, if there is a large change in acoustic load compared to a reference information, a high level of obstruction may be presented. If a small change in acoustic load is detected, the amount of obstruction can be indicated as low. As noted above, if there is low level of obstruction, the user may still be allowed to use the device, but an equalization correction may be provided or other suitable correction in an attempt to mitigate the low level obstruction until such time as a higher level of obstruction is detected.

Figure 21:
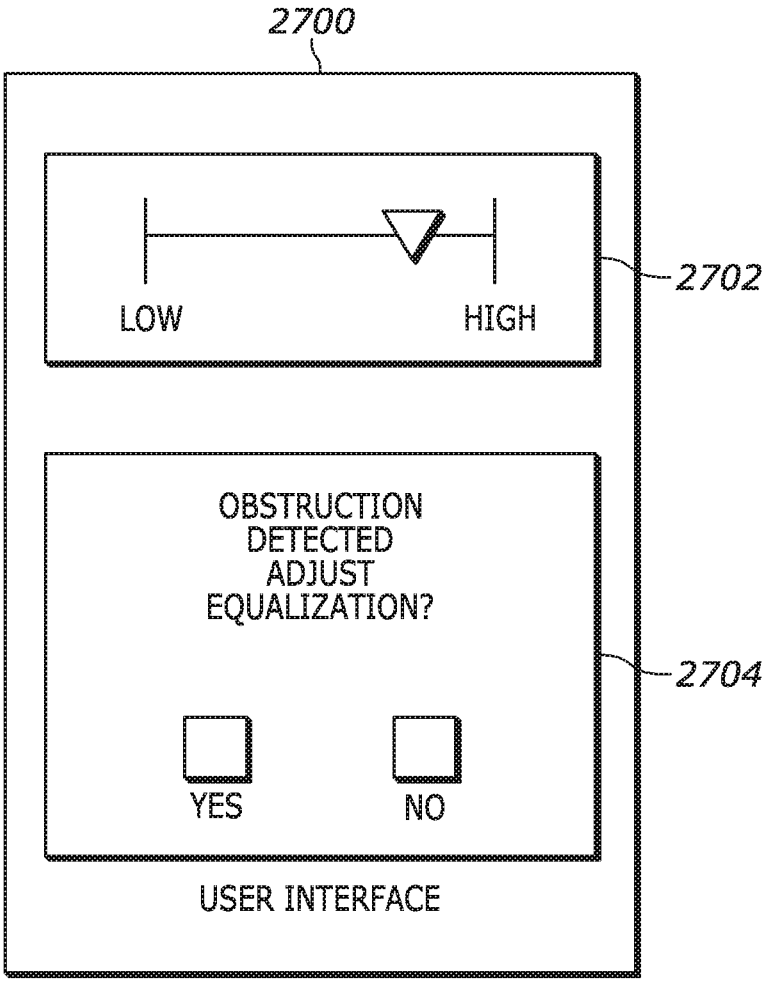
FIG. 21 illustrates an example of a user interface.
Figure 22:
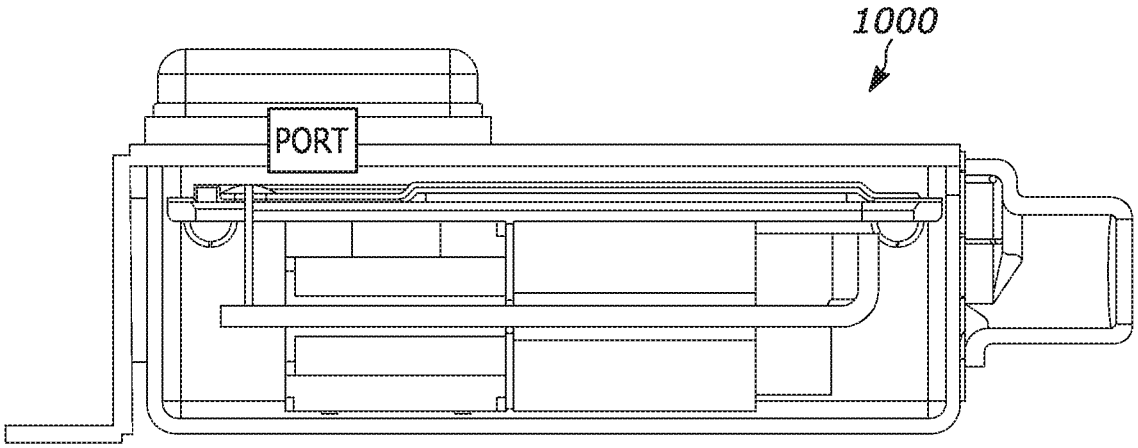
FIG. 22 illustrates an example of a sensor location in an acoustic receiver.
Figure 23:
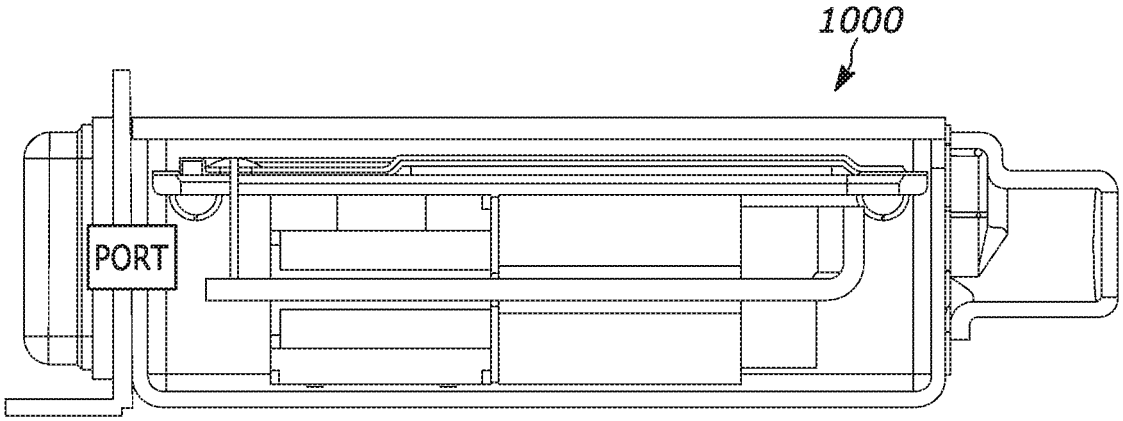
FIG. 23 illustrates an example of a sensor location in an acoustic receiver.
Figure 24:
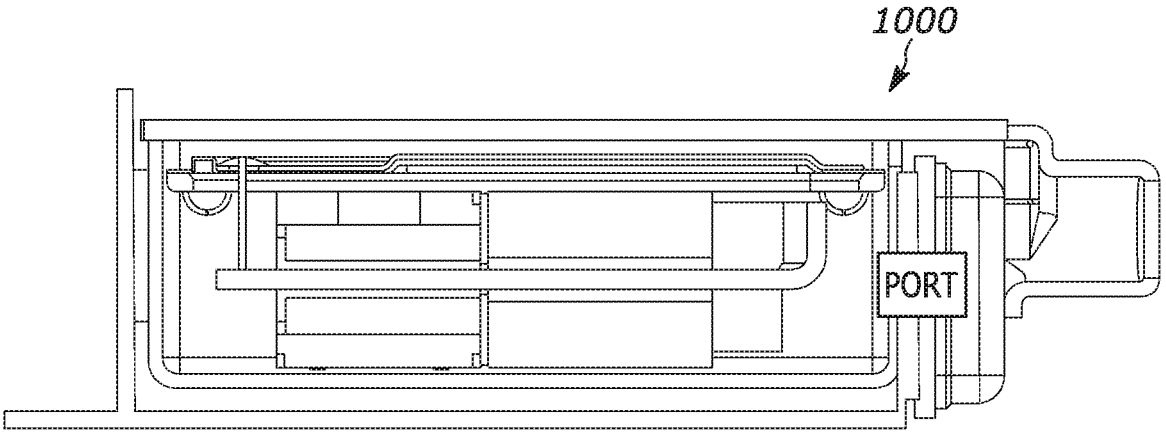
FIG. 24 illustrates an example of a sensor location in an acoustic receiver.
Figure 25:
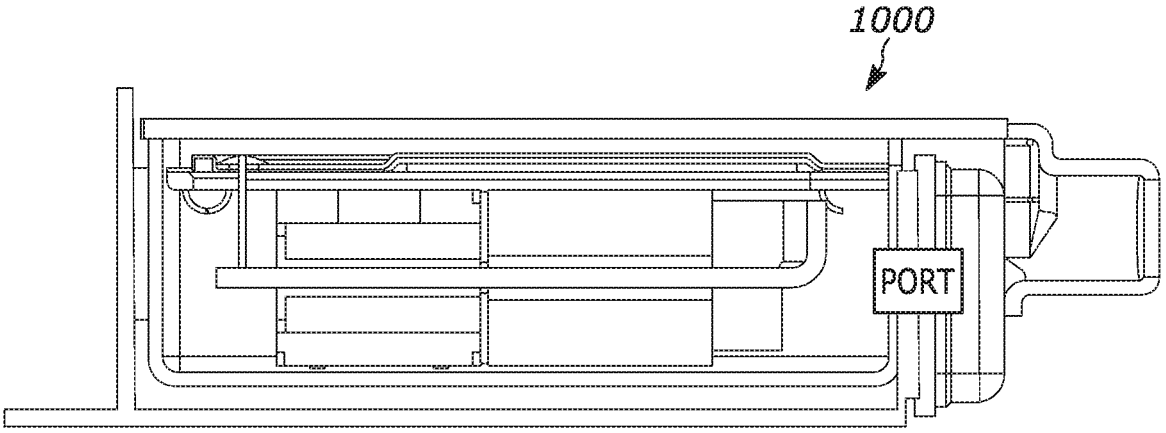
FIG. 25 illustrates an example of a sensor location in an acoustic receiver.
Figure 26:
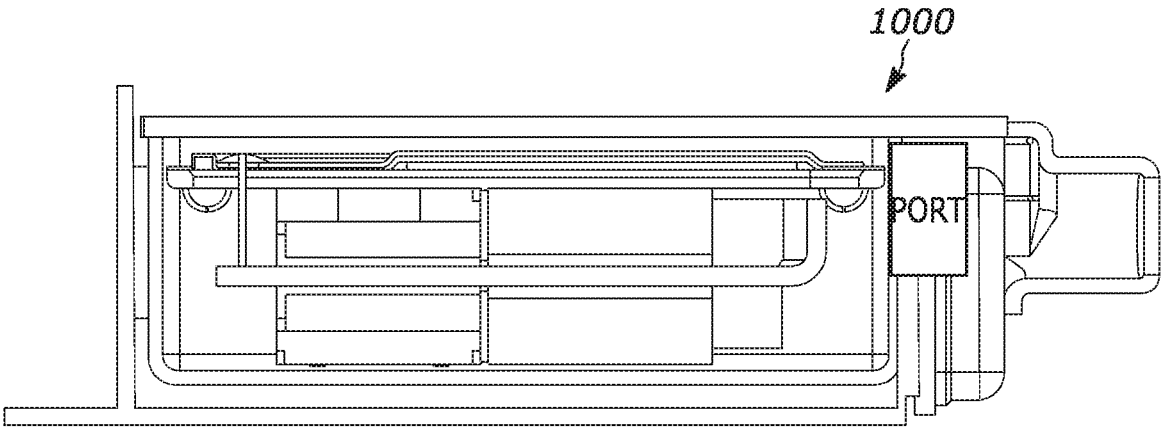
FIG. 26 illustrates an example of a sensor location in an acoustic receiver.

FIG. 21 illustrates another interface 2700 wherein the extent of the obstruction is indicated by presenting information 2702 to, for example, a user's smartphone or wearable device, or to the test system. As shown in block 2704, the user may be allowed to select that the pre-distortion operation be implemented to overcome the detected level of obstruction or seal leakage. The user interface information shown in FIGS. 20 and 21 may be considered notification information.

As noted above, one or more sensors may be used in connection with the front volume, rear volume or receiver output port (acoustic passage) to monitor changes in the characteristics of the acoustic receiver. As such, automatic detection of earwax accumulation, acoustic leakage, such as seal leakage of the seal surrounding the acoustic receiver when in place in a user's ear is provided. A change in characteristic may be a change from an expected transfer metric in the form of a change in frequency response to the receiver as noted above. Incremental changes in acoustic blockage that correspond to wax accumulation in a hearing aid, for example, are detected using reference information such as data representing a transfer function of the receiver prior to any wax buildup. Similarly reference information corresponding to a transfer function of the receiver prior to an acoustic leakage is used. The techniques noted above may also determine how severe or the extent to which the condition exists. As noted above, if desired, the detection of a change in the condition of the receiver may be accompanied by an equalization to automatically compensate for the change in condition associated with the receiver, however this may not be desired.

As noted above, notification of the results of the test may also be pushed to other devices such as a wearable device, smartphone, or any other suitable device. In response to determining that a change in acoustic load is present, in one example, the processor sends at least one of either a wireless notification to a remote device indicating that a change in acoustic load has been detected, or sends an electrical signal to the acoustic receiver causing the acoustic receiver to produce an audible notification or send a notification signal to the hearing device that causes a visual or audible generator such as an LED, speaker, vibration mechanism or other component of the hearing device to be activated. The reference information may be a threshold that is absolute or relative to an earlier measured value, results of the test as noted above may be communicated as pass/fail, numerical value, or a complete frequency sweep indication. For a wax accumulation level that is considered acceptable, that information could be communicated in the form of an estimation of acoustical impedance of the blockage or the raw data could be communicated. The raw test data could be a frequency response of the receiver, a change in resonance such as the frequency of peak or valley, quality factor, change in frequency, change in amplitude at a particular frequency or range of frequencies, curves that show multiple features that are detected are communicated. The initial frequency response information, for example, that may be stored as reference information, such as the initial frequency response of the device when new at the factory, or other operational points of the device. A suitable protocol can be used to transmit the test information as known in the art, such as I2C, UART, SPI, GPIO, Soundwire, or other suitable wired or wireless communication protocols.

In addition, the resulting determination from the test for ear wax accumulation may be uploaded to a web server of the manufacturer or audiologist that services the device so that remote monitoring of the health of the unit may be carried out. The web server that receives the data then evaluates the test results and if the test results exceed a threshold, the web server initiates an electronic calendar event to set up an appointment for the user of the device and an audiologist or other service provider to have the device fixed. As such, a type of push operation occurs so that a proactive maintenance operation can be carried out before the device reaches an unacceptable performance level of operation from the user's perspective.

The front volume sensor is used, in one example, to monitor low frequency information. In this example, a inaudible test signal can be injected into the receiver so that the sound is below the threshold of user detection and used to monitor the performance of the acoustic receiver. As such, an unobtrusive technique is used to determine changes in the characteristic of the receiver using a front volume sensor. This test can be done when the device is in ear or in use by a user without the user being aware that the device is being tested. Given the low sound pressures being detected, a longer measurement time may be required, although the measurement time would still be suitable for the application. If the device is for a hearing impaired individual where the frequency of impairment is known, the test signal can be set below the detectable frequency of the individual as opposed to a inaudible frequency, if desired. Even if the user in not hearing impaired, the test signal can be set to an inaudible level for a particular user.

When the monitored information is sent to a different remote device such as a wearable or smartphone, a smartphone app may accumulate the measured results, and if the measured results reach an undesirable threshold, may send a text message or on screen message for the user notifying the user that device should be serviced. The threshold determination may also be done by the processor in the hearing device so that, as noted above, the hearing device sends a "fail" message notifying the user of the device that the device needs servicing. The remote device may also initiate a calendar event when the measured information is approaching a critical threshold to provide an advance servicing of the device before it reaches an undesirable threshold where the user's ability to hear is impacted or when the performance of the device is below a desired level.

In addition, it has been found that using a back volume sensor may provide advantages such as but not limited to providing good detection capability at resonant frequencies of the receiver and low likelihood of ear wax occlusion in the back volume among others. In some cases the front volume sensor may be desirable since the front volume sensor may provide a large operating range, there is a smaller risk of wax occlusion compared to the output port and a change in acoustic load can be detected without using reference frequency response information, among other advantages. Using an output port sensor may be desirable in some applications due to good detection at resonance frequencies and complete blockage may be detected with a pressure measurement among other advantages. However it will be recognized that any suitable sensor or combination of sensors may be desirable depending on, among other things, a given application and desired operation.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. An acoustic device comprising:

an armature-based acoustic receiver including a housing having a diaphragm, coupled to the armature, the diaphragm defining a front volume and a back volume the front volume coupled to an output of the housing;

at least one electro-acoustic transducer positioned in at least one of the front volume or the back volume of the receiver; and an electrical circuit operative to determine whether there is a change in an acoustic signal of the receiver based on pressure sensed by the at least one electro-acoustic transducer, wherein the change in the acoustic signal is indicative of a change in an acoustic load coupled to the receiver.

2. The device of claim 1, the electrical circuit operative to determine whether there is a change in the acoustic signal by comparing data representing a measured transfer metric of the receiver to data representing an expected transfer metric of the receiver, wherein the measured transfer metric is a ratio of an acoustic output signal of the receiver to an electrical input signal of the receiver, and the expected transfer metric is a ratio of a reference acoustic output signal of the receiver to a reference electrical input signal of the receiver for a reference test load.

3. The device of claim 2, the electrical circuit operative to compare the measured transfer metric to the expected transfer metric for a range of frequencies between approximately 1 octave below a resonance frequency of the receiver and approximately 1 octave above the resonance frequency of the receiver.

4. The device of claim 2, the electrical circuit operative to provide a inaudible test signal, as the electrical input signal, and wherein the at least one electro-acoustic transducer is located in the front volume of the receiver.

5. The device of claim 2, the electrical circuit operative to provide a notification when there is a change in the acoustic signal indicative of a change in the acoustic load.

6. The device of claim 1 in combination with an acoustic load; acoustically coupled to the output of the receiver.

7. The device of claim 5, wherein the change in the acoustic signal is indicative of a change in an obstruction of the output, and wherein the expected transfer metric is a ratio of the reference acoustic output signal to a reference electrical input signal for a reference test load representing an unobstructed receiver.

8. The device of claim 5, wherein the change in the acoustic signal is indicative of a change in acoustic leakage, wherein the expected transfer metric is a ratio of the reference acoustic output signal to a reference electrical input signal for a reference test load including reference leakage.

9. The device of claim 5, wherein the electro-acoustic transducer is located to sense pressure in the front volume of the receiver and the electro-acoustic transducer is disposed on a substrate that forms part of the front volume of the receiver.

10. The device of claim 5, wherein the electro-acoustic transducer is located to sense pressure in the back volume of the receiver and the electro-acoustic transducer is disposed on a substrate that forms part of the back volume of the receiver.

11. The device of claim 5, wherein the electro-acoustic transducer is located to sense pressure in the output of the receiver and the electro-acoustic transducer is disposed on a substrate that forms part of the output of the receiver.

12. An armature based acoustic receiver comprising:

a housing having a diaphragm, coupled to an armature, that defines a front volume and a back volume, the front volume coupled to an output port of the housing; and at least one electro-acoustic transducer positioned to sense pressure in at least one of the front volume and the back volume.

13. An integrated circuit comprising:

circuitry operative to apply an electrical input signal, for an armature based acoustic receiver, at an output of the integrated circuit;

circuitry operative to determine whether there is a change in an acoustic signal of the receiver by comparing a measured transfer metric to an expected transfer metric, the measured transfer metric is a ratio of an acoustic output signal of the receiver to the electrical input signal, and the expected transfer metric is ratio of a reference acoustic output signal of the receiver to a reference electrical input signal of the receiver for a reference test load.

14. The integrated circuit of claim 13, the electrical circuit operative to determine whether there is a change in the acoustic signal by comparing data representing a measured transfer metric of the receiver to data representing an expected transfer metric of the receiver, wherein the measured transfer metric is a ratio of an acoustic output signal of the receiver to an electrical input signal of the receiver, and the expected transfer metric is a ratio of a reference acoustic output signal of the receiver to a reference electrical input signal of the receiver for a reference test load.

15. The integrated circuit of claim 14, the electrical circuit operative to compare the measured transfer metric to the expected transfer metric for a range of frequencies between approximately 1 octave below a resonance frequency of the receiver and approximately 1 octave above the resonance frequency of the receiver.

16. The integrated circuit of claim 14, the electrical circuit operative to provide a inaudible test signal, as the electrical input signal, and wherein the at least one electro-acoustic transducer is located in the front volume of the receiver.

17. The integrated circuit of claim 14, the electrical circuit operative to provide a notification when there is a change in the acoustic signal indicative of a change in the acoustic load.

18. The integrated circuit of claim 14, wherein the change in the acoustic signal is indicative of a change in an obstruction of the output, and wherein the expected transfer metric is a ratio of the reference acoustic output signal to a reference electrical input signal for a reference test load representing an unobstructed receiver.

19. The integrated circuit of claim 14, wherein the change in the acoustic signal is indicative of a change in acoustic leakage, wherein the expected transfer metric is a ratio of the reference acoustic output signal to a reference electrical input signal for a reference test load including reference leakage.

* * * * *